US010895374B2

(12) United States Patent
Tsai et al.

(10) Patent No.: US 10,895,374 B2
(45) Date of Patent: Jan. 19, 2021

(54) LIGHT SOURCE DEVICE

(71) Applicants: LITE-ON OPTO TECHNOLOGY (CHANGZHOU) CO., LTD., Jiangsu (CN); LITE-ON TECHNOLOGY CORPORATION, Taipei (TW)

(72) Inventors: Hsin-Wei Tsai, Kaohsiung (TW); I-Ju Chen, Taichung (TW); Hou-Yen Tsao, New Taipei (TW); Chia-Cheng Wu, Taoyuan (TW); Shu-Hua Yang, Taichung (TW); Yu-Hung Su, Taipei (TW)

(73) Assignees: LITE-ON OPTO TECHNOLOGY (CHANGZHOU) CO., LTD., Changzhou (CN); LITE-ON TECHNOLOGY CORPORATION, Taipei (TW)

( * ) Notice: Subject to any disclaimer, the term of this patent is extended or adjusted under 35 U.S.C. 154(b) by 19 days.

(21) Appl. No.: 16/535,719

(22) Filed: Aug. 8, 2019

(65) Prior Publication Data

US 2020/0049339 A1 Feb. 13, 2020

Related U.S. Application Data

(60) Provisional application No. 62/715,817, filed on Aug. 8, 2018.

(30) Foreign Application Priority Data

Jan. 31, 2019 (CN) ..... 2019 1 0098476

(51) Int. Cl.
*F21V 25/02* (2006.01)
*F21V 23/06* (2006.01)
(Continued)

(52) U.S. Cl.
CPC ..... *F21V 25/02* (2013.01); *F21V 15/01* (2013.01); *F21V 23/06* (2013.01); *F21Y 2115/10* (2016.08); *F21Y 2115/30* (2016.08)

(58) Field of Classification Search
CPC ..... F21V 25/02; F21V 23/06; F21V 15/01; F21V 3/061; F21V 25/04; F21V 23/0442;
(Continued)

(56) References Cited

U.S. PATENT DOCUMENTS 9,748,454 B2 * 8/2017 Lin ..... H01L 33/642
9,765,937 B2 * 9/2017 Cha ..... F21K 9/64
(Continued)

FOREIGN PATENT DOCUMENTS

CN 101329042 A 12/2008
CN 102054921 A 5/2011
(Continued)

*Primary Examiner* — Peggy A Neils
(74) *Attorney, Agent, or Firm* — Li & Cai Intellectual Property (USA) Office

(57) ABSTRACT

A light source device includes a substrate, an upper electrode layer and a lower electrode layer both respectively disposed on two opposite surfaces of the substrate, a light emitting unit mounted on the upper electrode layer, a surrounding frame disposed on the substrate and surrounding the light emitting unit, a conductive unit disposed on the surrounding frame, a light permeable member disposed on the surrounding frame and covering the light emitting unit, and a detecting circuit formed on an outer surface of the light permeable member. The lower electrode layer includes two coplanar sub-layers. The light emitting unit is electrically coupled to one of the two sub-layers through the upper electrode layer. The detecting circuit includes two contacts connected to the conductive unit, and is electrically coupled
(Continued)

to the second lower electrode sub-layer by the conductive unit electrically coupled to the other one of the two sub-layers.

22 Claims, 20 Drawing Sheets

(51) Int. Cl.
*F21V 15/01* (2006.01)
*F21Y 115/30* (2016.01)
*F21Y 115/10* (2016.01)

(58) Field of Classification Search
CPC ..... F21V 23/0464; F21Y 2115/30; F21Y 2115/10; F21Y 2105/10; F21Y 2105/16; H01L 33/62
See application file for complete search history.

(56) References Cited

U.S. PATENT DOCUMENTS

| | | | | |
|---|---|---|---|---|
| 10,260,734 | B2 * | 4/2019 | Kim | H01L 33/486 |
| 2016/0076728 | A1 * | 3/2016 | Feng | F21V 23/0464 362/20 |

FOREIGN PATENT DOCUMENTS

| | | | |
|---|---|---|---|
| CN | 201821002 | U | 5/2011 |
| CN | 102194779 | A | 9/2011 |
| CN | 203823501 | U | 9/2014 |
| CN | 107210583 | A | 9/2017 |
| CN | 107851962 | A | 3/2018 |
| JP | 2015106577 | A | 6/2015 |

* cited by examiner

LIGHT SOURCE DEVICE

CROSS-REFERENCE TO RELATED PATENT APPLICATION

This application claims the benefit of priority to China Patent Application No. 201910098476.6, filed on Jan. 31, 2019 in People's Republic of China. The entire content of the above identified application is incorporated herein by reference.

This application claims priority from U.S. Provisional Patent Application Ser. No. 62/715,817 filed on Aug. 8, 2018, which application is incorporated herein by reference in its entirely.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a light source device, and more particularly to a light source device having at least one detecting circuit formed on a light permeable member thereof.

BACKGROUND OF THE DISCLOSURE

A conventional light source device is not provided with a feedback mechanism for a damaged situation, so that when a light permeable member (e.g., a glass cover) of the conventional light source device is delaminated by an external force, light emitted from the conventional light source device will harm human eyes.

SUMMARY OF THE DISCLOSURE

In response to the above-referenced technical inadequacies, the present disclosure provides a light source device to effectively improve the issues associated with conventional light source devices.

In one aspect, the present disclosure provides a light source device, which includes a substrate, an upper electrode layer, a lower electrode layer, a light emitting unit, a surrounding frame, a conductive unit, a light permeable member, and at least one detecting circuit. The substrate has a first surface and a second surface that is opposite to the first surface. The upper electrode layer and the lower electrode layer are respectively disposed on the first surface and the second surface of the substrate. The lower electrode layer includes a first lower electrode sub-layer and a second lower electrode sub-layer that is coplanar with the first lower electrode sub-layer. The light emitting unit is mounted on the upper electrode layer. The light emitting unit is electrically coupled to the first lower electrode sub-layer through the upper electrode layer. The surrounding frame is disposed on the first surface and surrounds an external side of the light emitting unit. The conductive unit is disposed on the surrounding frame and is electrically coupled to the second lower electrode sub-layer. The conductive unit includes a plurality of first pads or a plurality of second pads, and a first height of the first pads on the surrounding frame with respect to the substrate is different from a second height of the second pads of the surrounding frame with respect to the substrate. The light permeable member is disposed on the surrounding frame and covers the light emitting unit. The at least one detecting circuit is formed on the light permeable member and includes at least two contacts. The at least two contacts of the at least one detecting circuit are connected to the first pads or the second pads, and the at least one detecting circuit is electrically coupled to the second lower electrode sub-layer through the conductive unit.

In one aspect, the present disclosure provides a light source device, which includes a substrate, an upper electrode layer, a lower electrode layer, a light emitting unit, a surrounding frame, a conductive unit, a light permeable member, and at least one detecting circuit. The substrate has a first surface and a second surface opposite to the first surface. The upper electrode layer and the lower electrode layer are respectively disposed on the first surface and the second surface of the substrate. The lower electrode layer includes a first lower electrode sub-layer and a second lower electrode sub-layer that is coplanar with the first lower electrode sub-layer. The light emitting unit is mounted on the upper electrode layer. The light emitting unit is electrically coupled to the first lower electrode sub-layer through the upper electrode layer. The surrounding frame is disposed on the first surface and surrounds an external side of the light emitting unit. The conductive unit is disposed on the surrounding frame and is electrically coupled to the second lower electrode sub-layer. The light permeable member is disposed on the surrounding frame and covers the light emitting unit. The light permeable member has an outer surface and an inner surface opposite to the outer surface. The at least one detecting circuit is formed on one of the inner surface and the outer surface of the light permeable member and includes two contacts. The two contacts of the at least one detecting circuit are connected to the conductive unit, and the at least one detecting circuit is electrically coupled to the second lower electrode sub-layer through the conductive unit.

Therefore, since the conductive unit is disposed on the surrounding frame, the at least one detecting circuit on the light permeable member can be electrically coupled to the second lower electrode sub-layer through the conductive unit. Accordingly, a controller can be used to test and obtain the impedance of the at least one detecting circuit through the second lower electrode sub-layer, thereby monitoring whether or not the light permeable member is damaged.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
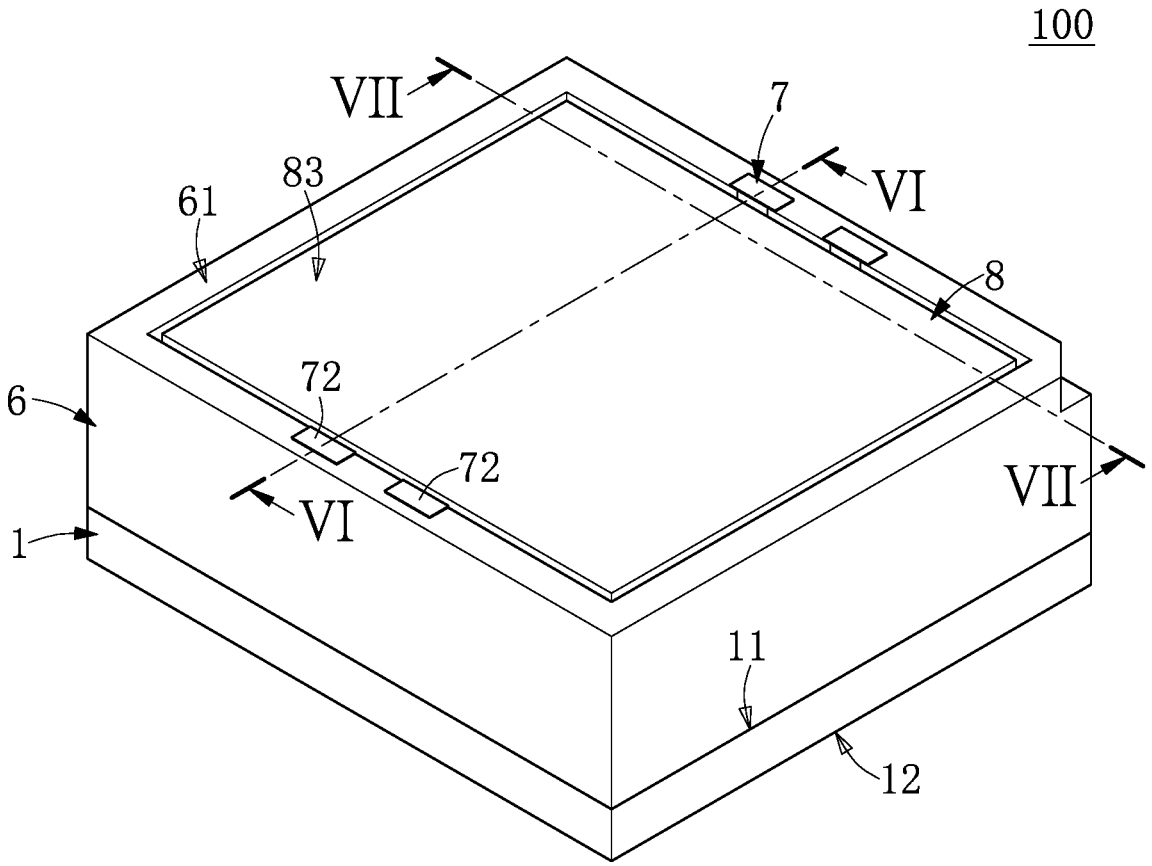
FIG. 1 is a perspective view of a light source device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
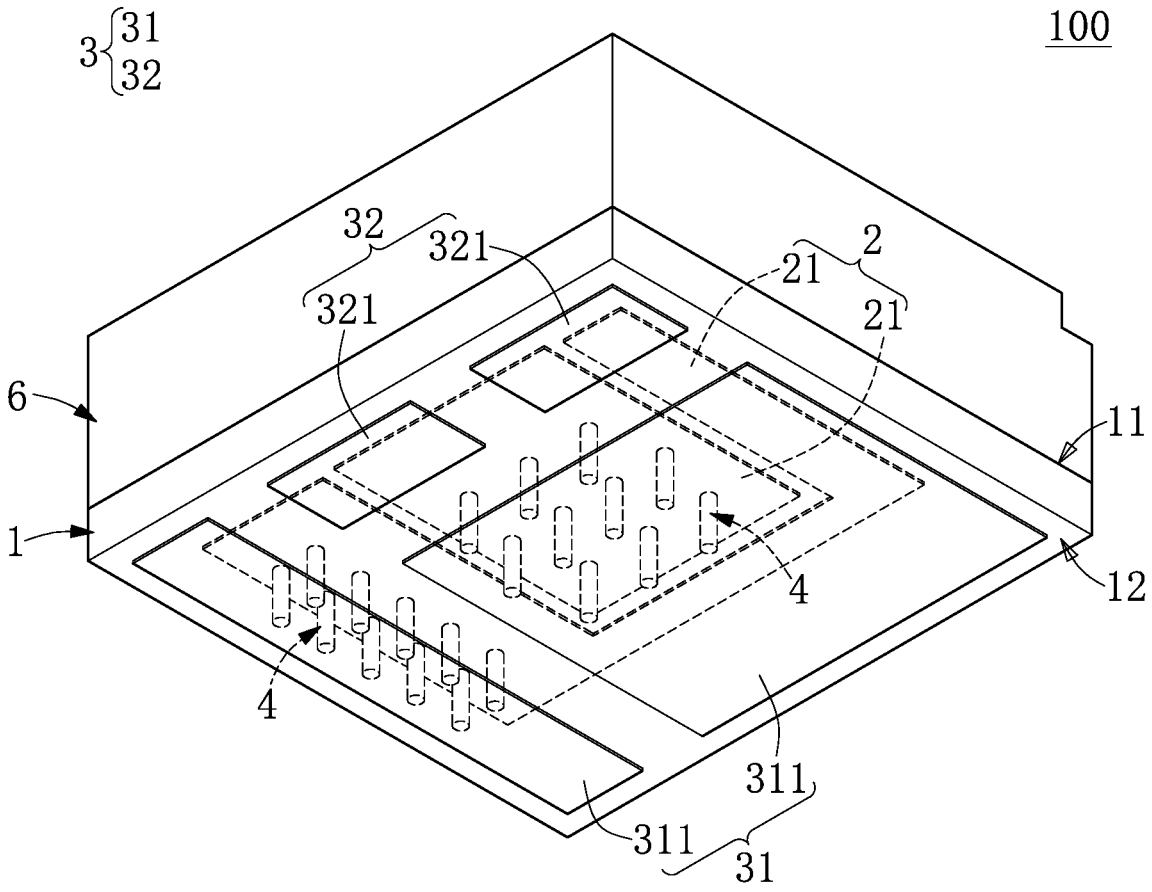
FIG. 2 is a perspective view of the light source device from another view angle.
Figure 3:
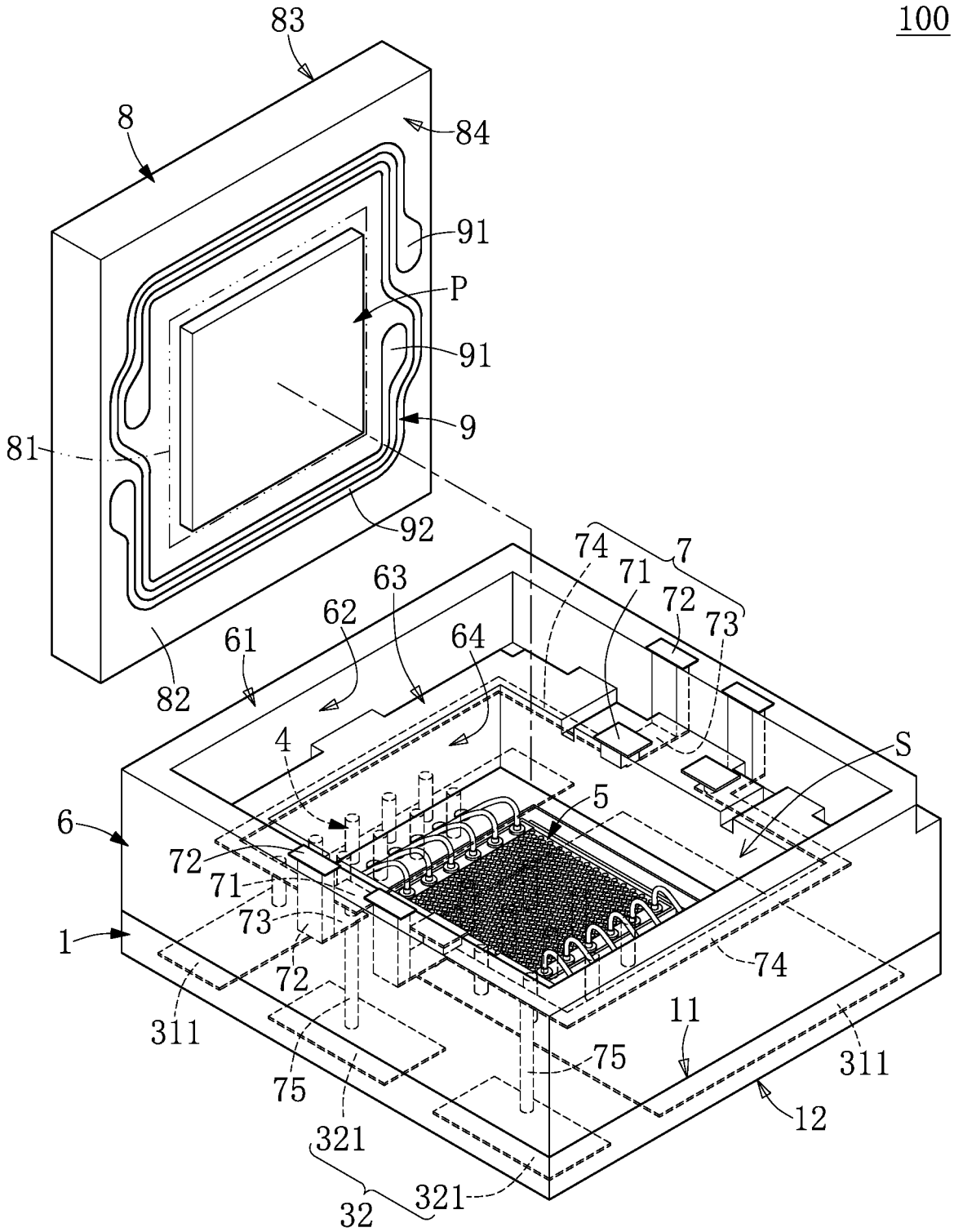
FIG. 3 is an exploded view of FIG. 1 with an adhesive layer omitted.

Referring to FIG. 1 to FIG. 16, embodiments of the present disclosure each provide a light source device 100. As shown in FIG. 1 to FIG. 3, the light source device 100 of the present embodiment includes a substrate 1, an upper electrode layer 2 and a lower electrode layer 3 both disposed on two opposite sides of the substrate 1, a plurality of conductive posts 4 embedded in the substrate 1, a light emitting unit 5 disposed on the upper electrode layer 2, a surrounding frame 6 disposed on the substrate 1 and surrounding an external side of the light emitting unit 5, a conductive unit 7 disposed on the surrounding frame 6, a light permeable member 8 disposed on the surrounding frame 6 and covering the light emitting unit 5, two detecting circuits 9 formed on the light permeable member 8, and an adhesive layer G (shown in FIG. 7) connecting and fixing the light permeable member 8 and the surrounding frame 6. The following description describes the structure and connection relationship of each component of the light source device 100.

Figure 4:
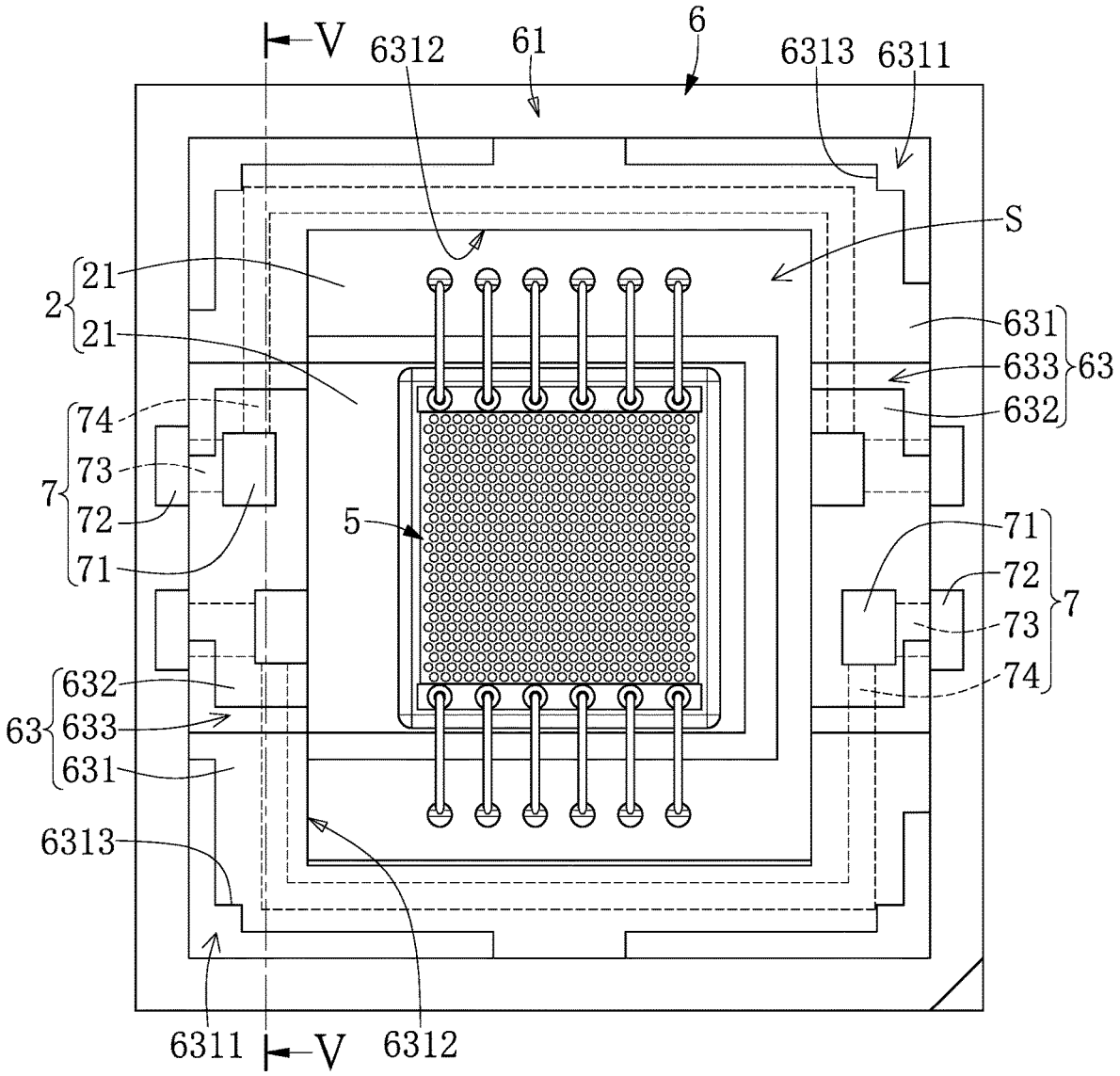
FIG. 4 is a top view of FIG. 3 with the adhesive layer and a light permeable member both omitted.

As shown in FIG. 2 to FIG. 4, the substrate 1 in the present embodiment is substantially in a rectangular shape or a square shape. The substrate 1 of the present embodiment includes a first surface 11 and a second surface 12 opposite to the first surface 11. The substrate 1 of the present embodiment is an insulating substrate, such as a circuit board or a ceramic board having a better heat-dissipating performance, but the present disclosure is not limited thereto.

The upper electrode layer 2 is disposed on the first surface 11 of the substrate 1, and includes two upper electrodes 21 provided for die-bonding and wire-bonding of the light emitting unit 5. The lower electrode layer 3 is disposed on the second surface 12 of the substrate 1, and includes a first lower electrode sub-layer 31 and a second lower electrode sub-layer 32 that is coplanar with the first lower electrode sub-layer 31. The first lower electrode sub-layer 31 includes two first lower electrodes 311, and the second lower electrode sub-layer 32 includes two second lower electrodes 321. The two first lower electrodes 311 of the first lower electrode sub-layer 31 are electrically coupled to the two upper electrodes 21 of the upper electrode layer 2, respectively, through the conductive posts 4. The two second lower electrodes 321 of the second lower electrode sub-layer 32 are electrically coupled to the conductive unit 7.

Specifically, as shown in FIG. 2 and FIG. 3, a first group of the conductive posts 4 is arranged under the light emitting unit 5, and a second group of the conductive posts 4 is arranged under a part of the upper electrode layer 2 that is configured to provide wire-bonding of the light emitting unit 5.

As shown in FIG. 2 to FIG. 4, the light emitting unit 5 in the present embodiment is a Light-Emitting Diode (LED) or a laser diode, such as a Vertical-Cavity Surface-Emitting Laser (VCSEL) or an edge-emitting semiconductor laser, but the present disclosure is not limited thereto. The light emitting unit 5 is mounted on a center portion of the upper electrode layer 2, and is electrically coupled to the first lower electrode sub-layer 31 through the upper electrode layer 2 and the corresponding conductive posts 4. In the present embodiment, the light emitting unit 5 is mounted on one of the two upper electrodes 21, and is electrically coupled to the other upper electrode 21 in a wire-bonding manner, so that the light emitting unit 5 can be electrically coupled to the first lower electrode sub-layer 31 through the upper electrodes 21 and the corresponding conductive posts 4.

As shown in FIG. 3 and FIG. 4, the surrounding frame 6 is disposed on the first surface 11 of the substrate 1, and is arranged to surround the external side of the light emitting unit 5. Moreover, outer lateral sides of the surrounding frame 6 are preferably flush with outer lateral sides of the substrate 1. A periphery portion of the upper electrode layer 2 is preferably embedded in the surrounding frame 6, thereby increasing the bonding force between the substrate 1 and the upper electrode layer 2. An inner portion of the surrounding frame 6 is an annular step-like structure, and the surrounding frame 6 in the present embodiment is formed by a ceramic material or a polymer material, but the present disclosure is not limited thereto. For example, in other embodiments of the present disclosure, the surrounding frame 6 and the substrate 1 can be integrally formed as a one-piece structure.

Specifically, the surrounding frame 6 sequentially includes an upper tread 61, an upper riser 62 connected to an inner edge of the upper tread 61, a lower tread 63 arranged at an inner side of the upper riser 62, and a lower riser 64 connected to an inner edge of the lower tread 63 and arranged away from the upper tread 61. The upper tread 61, the upper riser 62, the lower tread 63, and the lower riser 64 are sequentially arranged from an outer side to an inner side of the surrounding frame 6.

The upper tread 61 is in a rectangular and angular shape or a square and angular shape, and is arranged away from the substrate 1. The upper tread 61 in the present embodiment is a top surface of the surrounding frame 6, and is preferably parallel to the first surface 11 of the substrate 1. The upper riser 62 is in a rectangular and angular shape or a square and angular shape, and is perpendicularly connected to the inner edge of the upper tread 61. The lower tread 63 is in a rectangular and angular shape or a square and angular shape, and is connected to an inner side of the upper riser 62. The lower tread 63 is preferably parallel to the upper tread 61, and a distance between the lower tread 63 and the first surface 11 is less than a distance between the upper tread 61 and the first surface 11. The lower riser 64 is in a rectangular and angular shape or a square and angular shape. The lower riser 64 is perpendicularly connected to the inner edge of the lower tread 63. The lower riser 64 and the first surface 11 of the substrate 1 jointly surround to form an accommodating space S. The light emitting unit 5 is arranged in the accommodating space S. That is to say, the lower riser 64 surrounds the external side of the light emitting unit 5.

Moreover, the lower tread 63 in the present embodiment includes two U-shaped regions 631 having inner edges 6312 facing each other, two functional regions 632 arranged between the two U-shaped regions 631, and a plurality of separating slots 633. Two external corners 6313 of each of the two U-shaped regions 631 each have a receiving groove 6311 for accommodating a part of the adhesive layer G, and each of the receiving grooves 6311 is substantially in an L-shaped along the shape of each corner. The two functional regions 632 are spaced apart from the two U-shaped regions 631 through the separating slots 633. In other words, each of the two functional regions 632 is spaced apart from any of the U-shaped regions 631 through one of the separating slots 633, so that the two functional regions 632 can avoid contacting with the adhesive layer G. In addition, each of the separating slots 633 can also be used as an air-escape passage.

Figure 5:
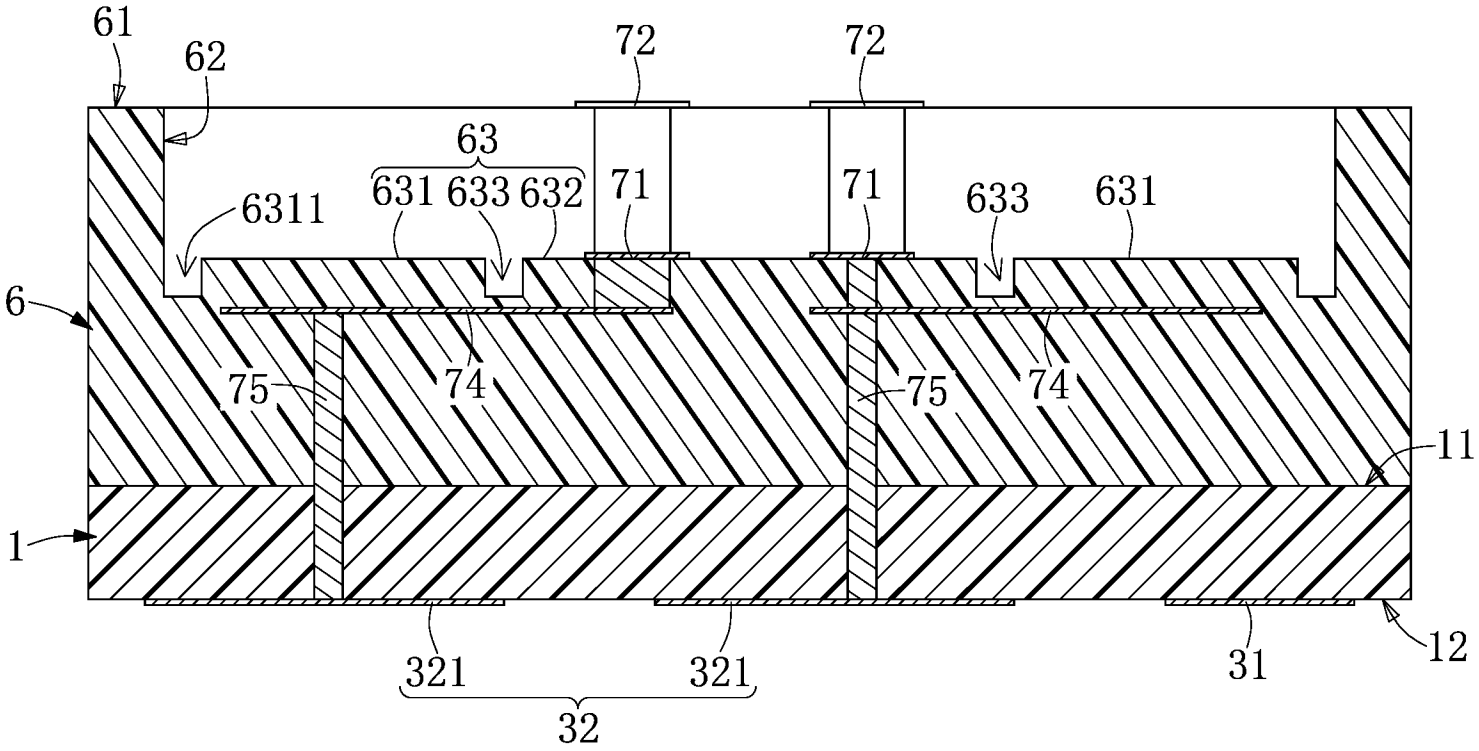
FIG. 5 is a cross-sectional view taken along the cross-sectional line V-V of FIG. 4.
Figure 6:
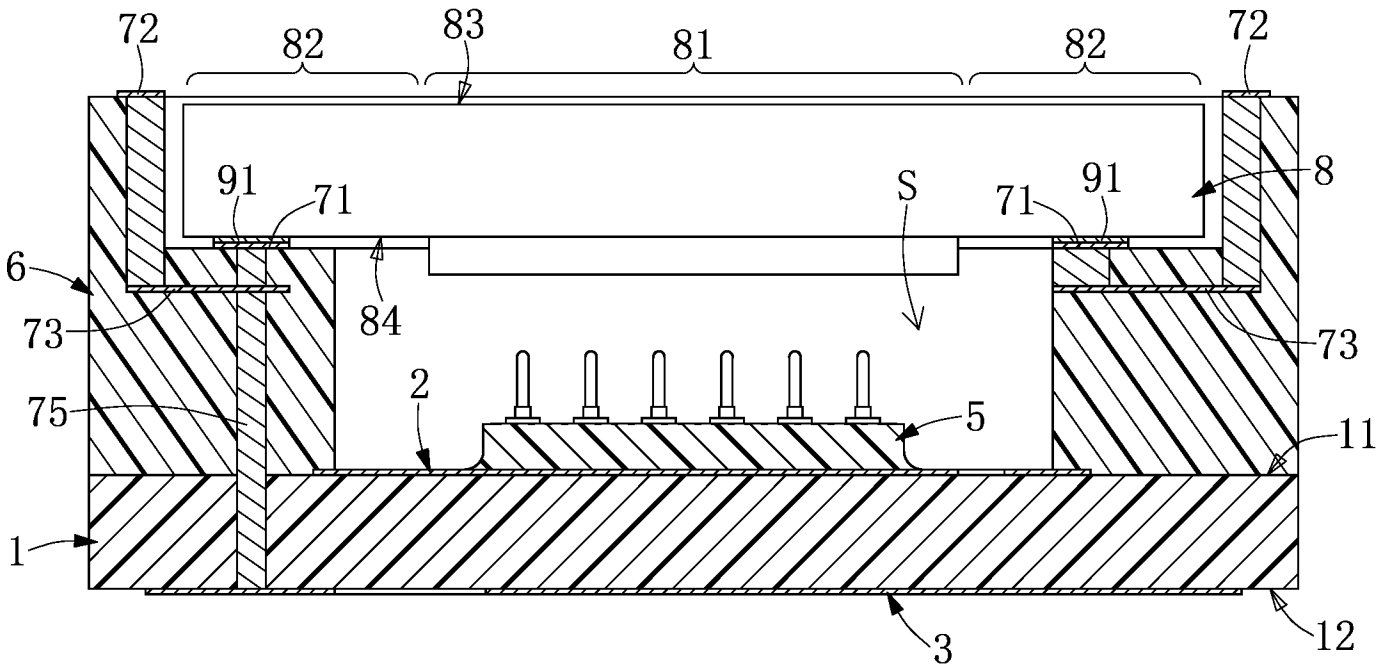
FIG. 6 is a cross-sectional view taken along the cross-sectional line VI-VI of FIG. 1.

As shown in FIG. 4 to FIG. 6, the conductive unit 7 is disposed on the surrounding frame 6, and is electrically coupled to the second lower electrode sub-layer 32. In the present embodiment, the conductive unit 7 includes a plurality of first pads 71, a plurality of second pads 72 corresponding in position to the first pads 71, a plurality of connecting traces 73 respectively connecting the first pads 71 to the second pads 72, two U-shaped transmission traces 74 respectively connected to the first pads 71, and two conductive pillars 75 respectively connected the two transmission traces 74 to the two second lower electrodes 321. In addition, the two transmission traces 74 are electrically coupled to the second lower electrode sub-layer 32 and the at least one detecting circuit 9.

The first pads 71 and the second pads 72 are disposed on the surrounding frame 6, and a first height of the first pads 71 on the surrounding frame 6 with respect to the substrate 1 is different from (e.g., lower than) a second height of the second pads 72 of the surrounding frame 6 with respect to the substrate 1. In the present embodiment, the first pads 71 are disposed on the lower tread 63 of the surrounding frame 6, and the second pads 72 are disposed on at least one of the upper tread 61 and the upper riser 62.

Specifically, the first pads 71 are respectively disposed on the two functional regions 632 of the lower tread 63. The second pads 72 are disposed on one of the upper tread 61 and the upper riser 62 (or disposed on the upper tread 61 and the upper riser 62), and the second pads 72 are respectively arranged adjacent to the first pads 71. The connecting traces 73 are embedded in the surrounding frame 6 under the lower tread 63, and two ends of each of the connecting traces 73 are connected to one of the first pads 71 and the corresponding second pad 72, so that the first pads 71 can be electrically coupled to the second pads 72 through the connecting traces 73.

Moreover, the two transmission traces 74 are embedded in the surrounding frame 6 under the lower tread 63 and are spaced apart from each other, and each of the two transmission traces 74 in the present embodiment is mostly arranged under one of the two U-shaped regions 631 and two of the separating slots 633 adjacent to the one of the two U-shaped regions 631. Two ends of each of the two transmission traces 74 are respectively connected to two of the first pads 71 respectively disposed on the two functional regions 632. In other words, a height of each of the two transmission traces 74 on the surrounding frame 6 with respect to the substrate 1 is lower than the first height of the first pads 71 on the surrounding frame 6 with respect to the substrate 1.

Parts of the two transmission traces 74 are respectively arranged above the two second lower electrodes 321 of the second lower electrode sub-layer 32. The two conductive pillars 75 are embedded in the surrounding frame 6 and the substrate 1. One end of the two conductive pillars 75 are respectively connected to the two transmission traces 74, and the other end of the two conductive pillars 75 are respectively connected to the two second lower electrodes 321 of the second lower electrode sub-layer 32, so that the two transmission traces 74 are electrically coupled to the two second lower electrodes 321, respectively, through the conductive pillars 75.

It should be noted that the conductive unit 7 in the present embodiment is provided by including the above components, but the conductive unit 7 can be adjusted or changed according to design requirement. For example, in other embodiments of the present disclosure, the conductive unit 7 can exclude any second pads 72 and any connecting traces 73, or the first pads 71 of the conductive unit 7 can be only formed on one of the functional regions 632. The conductive unit 7 further can exclude any first pads 71, and the second pads 72 are electrically coupled to the conductive pillars 75 through the transmission traces 74.

In other embodiments of the present disclosure, the light source device 100 can be formed with two first pads 71 or four first pads 71, and the light source device 100 is formed without any second pads 72. Or, the light source device 100 can be formed with two second pads 72 or four second pads 72, and the light source device 100 is formed without any first pads 71. Specifically, if the light source device 100 is formed with the two first pads 71, the two first pads 71 can be disposed on the same functional region 632 so as to be arranged adjacent to each other, or can be respectively arranged on the two functional regions 632 so as to be arranged away from each other. In addition, if the light source device 100 is formed with the two second pads 72, the two second pads 72 can be disposed on the same functional region 632 so as to be arranged adjacent to each other, or can be respectively arranged on the two functional regions 632 so as to be arranged away from each other.

Figure 7:
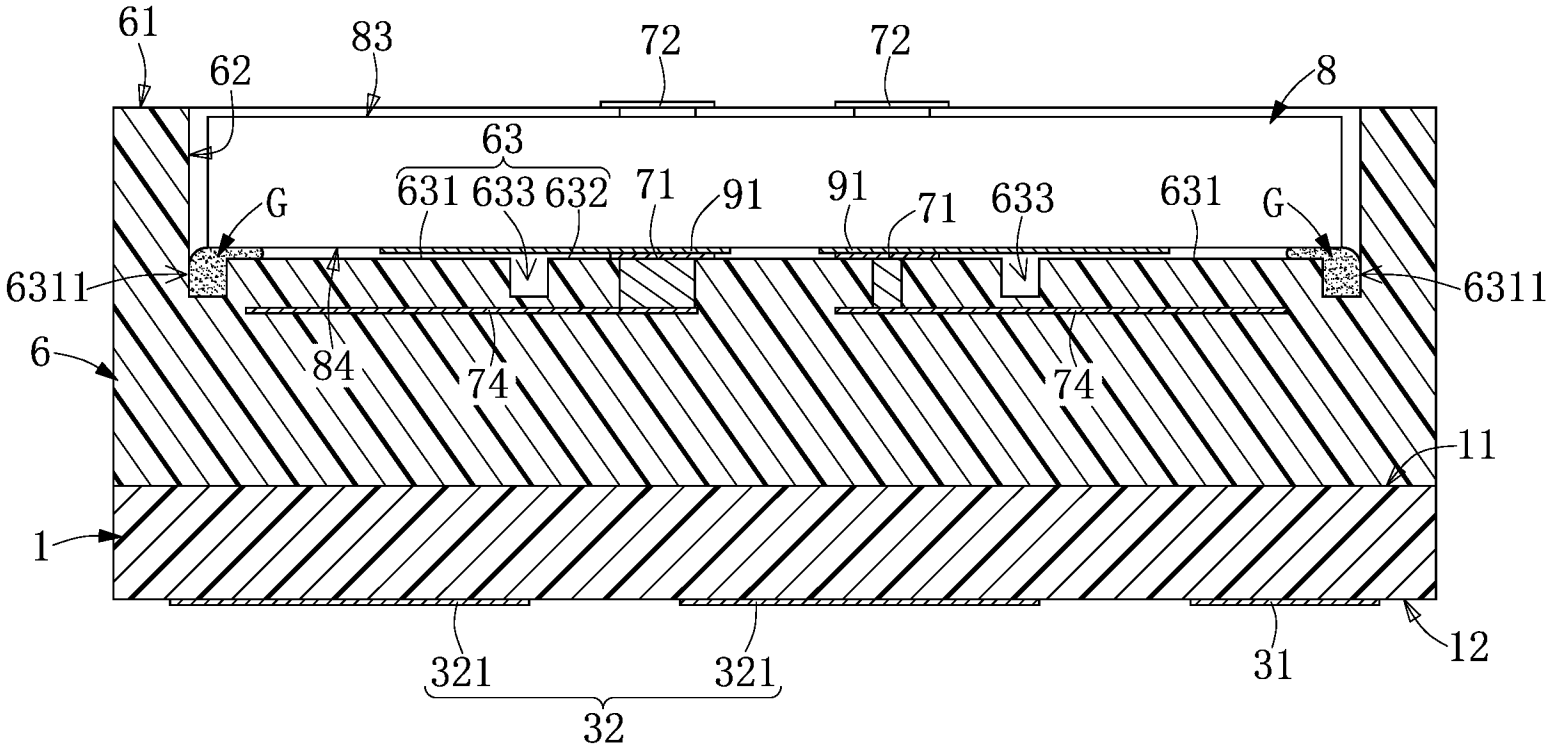
FIG. 7 is a cross-sectional view taken along the cross-sectional line VII-VII of FIG. 1.

As shown in FIG. 3, FIG. 6, and FIG. 7, the light permeable member 8 is disposed on the lower tread 63 of the surrounding frame 6, and is spaced apart from the upper riser 62 (i.e., the light permeable member 8 does not contact the upper riser 62). The light permeable member 8 in the present embodiment has a central portion 81 and a periphery portion 82 arranged around the central portion 81. The light emitting unit 5 is located directly under the central portion 81, and the periphery portion 82 corresponds in position to the surrounding frame 6. Moreover, the light permeable member 8 has an outer surface 83 and an inner surface 84 that is opposite to the outer surface 83, and the inner surface 84 faces the light emitting unit 5. The outer surface 83 of the light permeable member 8 is lower than the upper tread 61 of the surrounding frame 6 with respect to the substrate 1, but the present disclosure is not limited thereto. For example, in other embodiments of the present disclosure, the outer surface 83 of the light permeable member 8 can protrude from the upper tread 61 of the surrounding frame 6.

Specifically, the light permeable member 8 in the present embodiment includes a transparent glass board and a light-diffusion polymer layer P formed on the transparent glass board. The light-diffusion polymer layer P is arranged on the inner surface 84 of the central portion 81, and faces the light emitting unit 5. Moreover, each of the receiving grooves 6311 of the surrounding frame 6 is configured to receive a part of the adhesive layer G, and the other part of the adhesive layer G overflows from the receiving grooves 6311 for fixing the inner surface 84 of the periphery portion 82 onto the lower tread 63, so that the light permeable member 8 can be fixed onto the surrounding frame 6.

As shown in FIG. 3, FIG. 6, and FIG. 7, the two detecting circuits 9 are formed on the light permeable member 8, and each of the two detecting circuits 9 in the present embodiment is formed on the inner surface 84 of the light permeable member 8 and is located on the periphery portion 82 of the light permeable member 8. Each of the two detecting circuits 9 is light permeable (e.g., a transparent conductive film that can be formed by Indium Tin Oxides, ITO, indium zinc oxide, IZO, or other transparent conductive material), and includes two contacts 91 and a detecting trace 92 connected to the two contacts 91. In one of the two detecting circuits 9, the two contacts 91 are arranged adjacent to one of edges of the light permeable member 8 and are configured to be a first pair, and the detecting trace 92 is arranged along the other edges of the light permeable member 8 so as to connect the first pair of the contacts 91. In the other one of the two detecting circuits 9, the two contacts 91 are arranged adjacent to one of edges of the light permeable member 8 opposite to the first pair and are configured to be a second pair, and the detecting trace 92 is arranged along the other edges of the light permeable member 8 so as to connect the second pair of the contacts 91. It should be noted that each of the two detecting traces 92 is in a substantial ring-shape, and at least one of the two contacts 91 of one of the two detecting circuits 9 is arranged at an inner side of the detecting trace 92 of the other one of the two detecting circuits 9. In addition, in other embodiments of the present disclosure, if the detecting circuit 9 is formed on the periphery portion 82 of the light permeable member 8, the detecting circuit 9 can be an opaque material.

The four contacts 91 of the two detecting circuits 9 correspond in position to the four first pads 71, respectively. The contacts 91 of the two detecting circuits 9 are respectively connected to the first pads 71 of the conductive unit 7, so that each of the two detecting circuits 9 can be electrically coupled to the second lower electrode sub-layer 32 through the conductive unit 7. The two contacts 91 of each of the detecting circuits 9 are respectively connected to two of the first pads 71 respectively connected to the two transmission traces 74, so that the two contacts 91 of each of the detecting circuits 9 can be electrically coupled to the two second lower electrodes 321, respectively.

In other embodiments of the present disclosure, the at least one detecting circuit 9 can be formed on the inner surface 84 of the light permeable member 8, the two contacts 91 of the at least one detecting circuit 9 are arranged adjacent to one of edges of the light permeable member 8 or are respectively arranged adjacent to two of the edges of the light permeable member 8 opposite to each other, and the two contacts 91 of the at least one detecting circuit 9 are respectively disposed on two of the first pads 71.

In addition, the light source device 100 can be provided with an assembly including the light permeable member 8 and the detecting circuits 9 that are formed on the outer surface 83 of the light permeable member 8. In other words, two different assemblies respectively provided by forming the detecting circuits 9 onto the outer surface 83 of the light permeable member 8 or forming the detecting circuit 9 onto the inner surface 84 of the light permeable member 8 can be applied to the light source device 100 through the conductive unit 7. Accordingly, the two contacts 91 of the detecting circuit 9 can be connected to the first pads 71 or the second pads 72.

Figure 8:
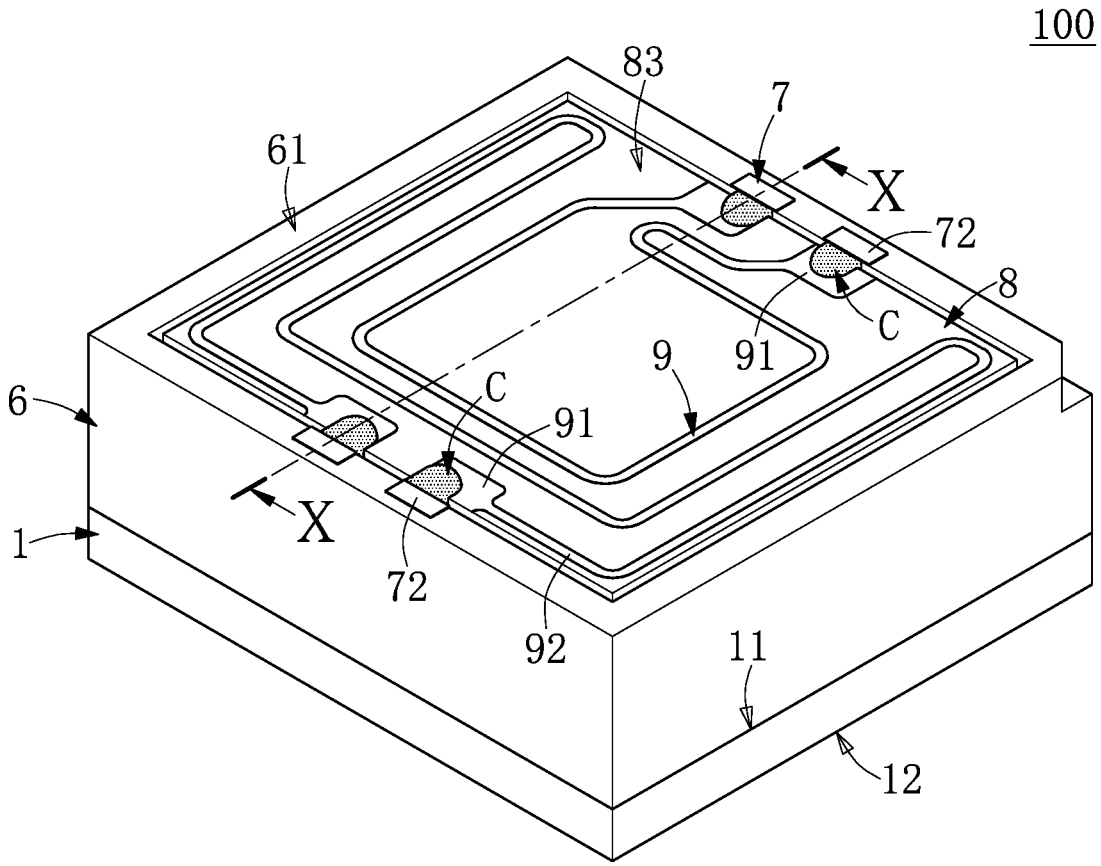
FIG. 8 is a perspective view of a light source device according to a second embodiment of the present disclosure.
Figure 9:
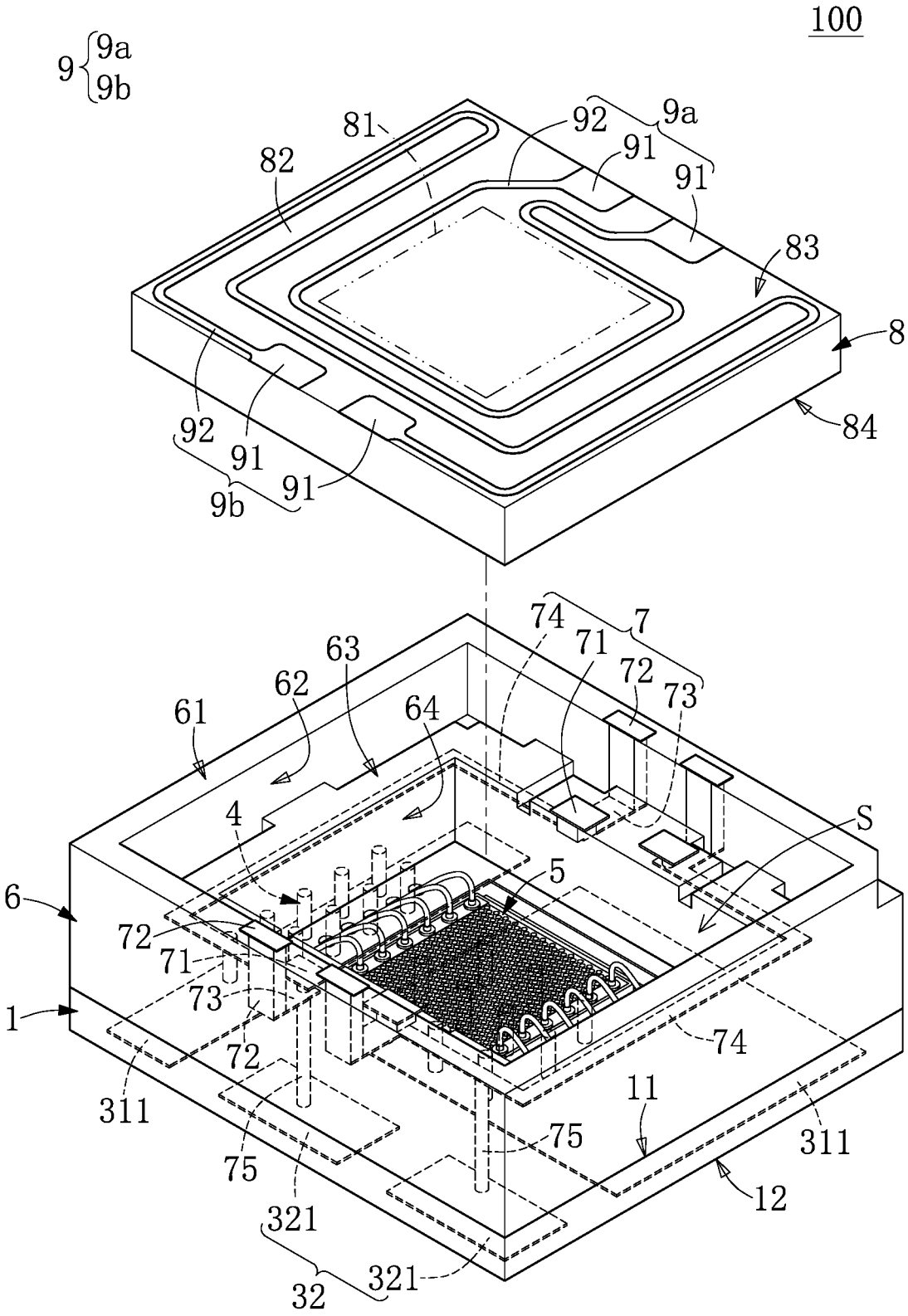
FIG. 9 is an exploded view of FIG. 8 with an adhesive layer and a conductive adhesive both omitted.
Figure 10:
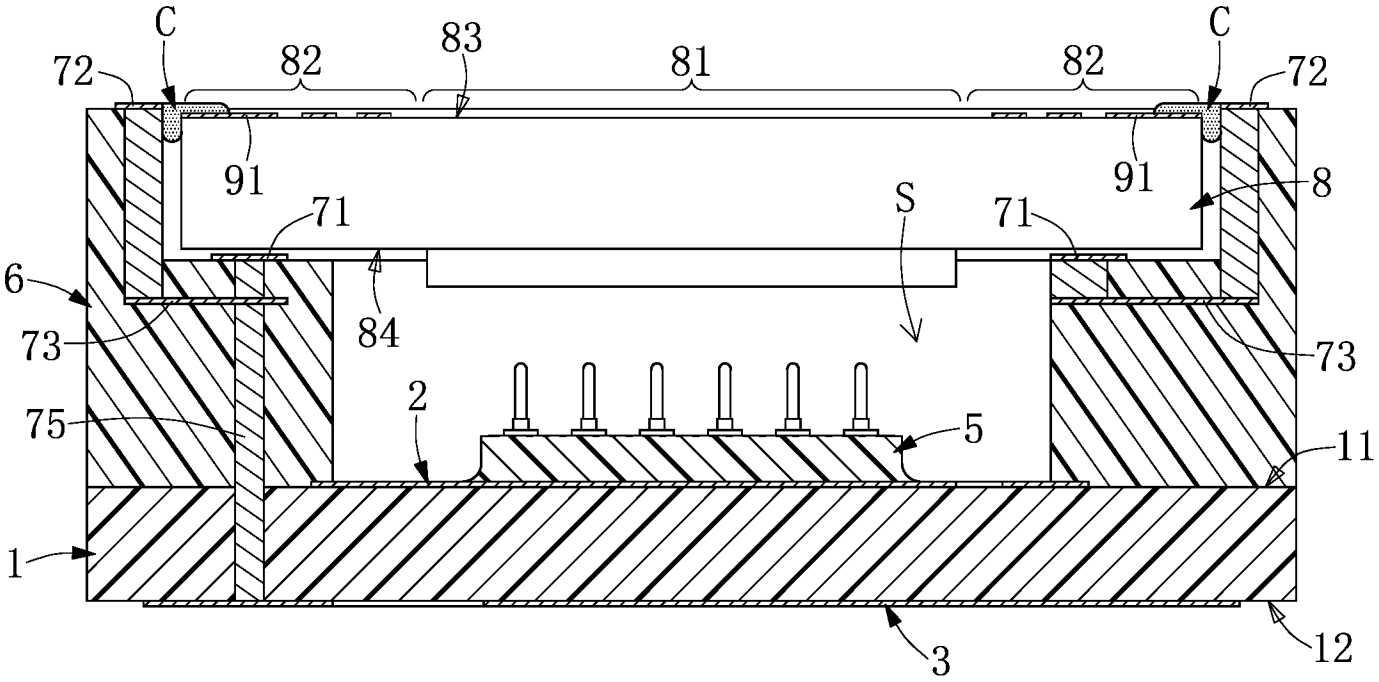
FIG. 10 is a cross-sectional view taken along the cross-sectional line X-X of FIG. 8.

Specifically, as shown in FIG. 8 to FIG. 10, the two detecting circuits 9 are formed on the outer surface 83 of the light permeable member 8, positions of the two detecting circuits 9 and the outer surface 83 of the light permeable member 8 are substantially lower than the upper tread 61 of the surrounding frame 6 with respect to the substrate 1, and the four contacts 91 of the two detecting circuits 9 correspond in position to the four second pads 72, respectively, so that the contacts 91 of the two detecting circuits 9 can be electrically coupled to the second pads 72 through the conductive adhesive C. The electrical connection between any one of the contacts 91 and the corresponding second pad 72 can be achieved by the following manner. The conductive adhesive C is filled into a gap between the light permeable member 8 and the upper riser 62 and extends to each of the contacts 91 and the corresponding second pad 72 so as to electrically connect the contact 91 and the corresponding second pad 72, but the present disclosure is not limited thereto. It should be noted that the two detecting circuits 9 are formed on the periphery portion 82 of the light permeable member 8 without being formed on the central portion 81. Moreover, the two contacts 91 of one of the two detecting circuits 9 are arranged adjacent to one of the edges of the light permeable member 8 and are configured to be a first pair, and the two contacts 91 of the other one of the two detecting circuits 9 are arranged adjacent to another edge of the light permeable member 8 opposite to the first pair and are configured to be a second pair. The two detecting circuits 9 are respectively defined as an inner detecting circuit 9*a* and an outer detecting circuit 9*b*, as shown in FIG. 9. The detecting trace 92 of the inner detecting circuit 9*a* is arranged around the central portion 81. The detecting trace 92 of the outer detecting circuit 9*b* is arranged around an external side of the inner detecting circuit 9*a*, and is substantially arranged along three of the edges of the light permeable member 8. In other words, an area surrounded by the inner detecting circuit 9*a* in the present embodiment is in a substantial square shape, and an area surrounded by the outer detecting circuit 9*b* is in a substantial U-shape.

Figure 11:
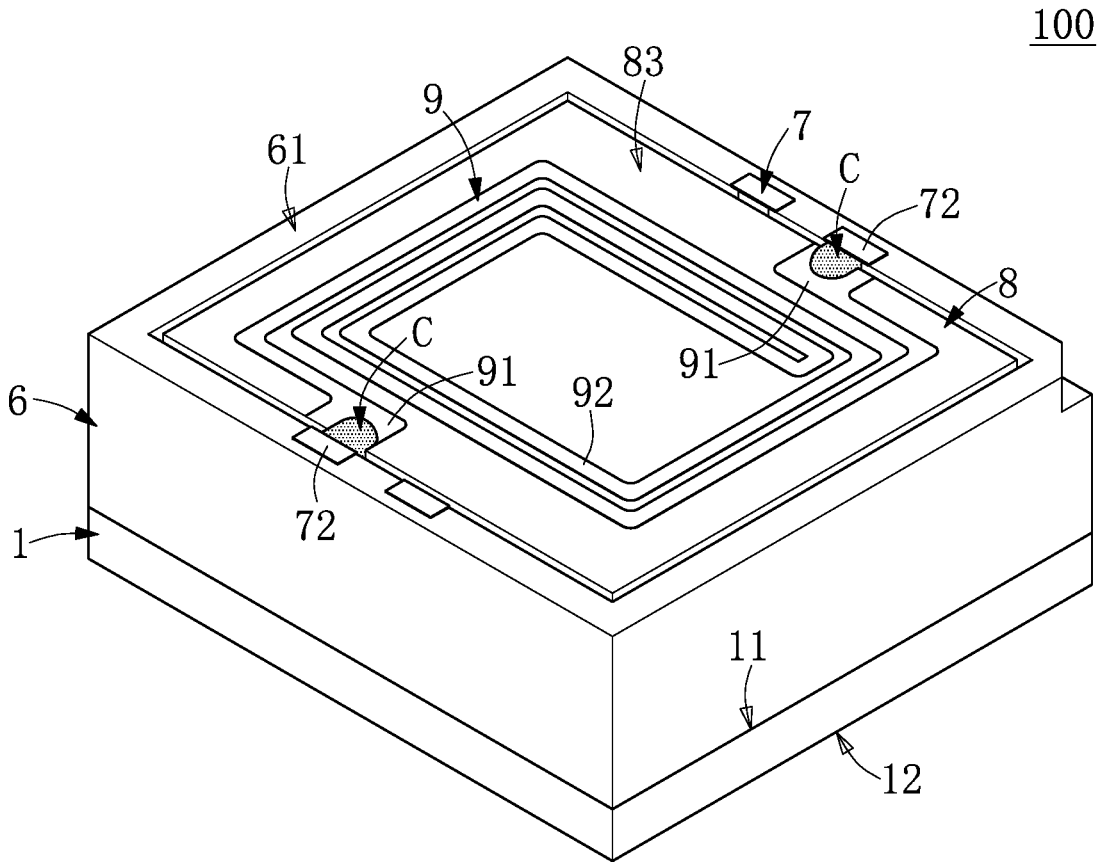
FIG. 11 is a perspective view of a light source device according to a third embodiment of the present disclosure.
Figure 12:
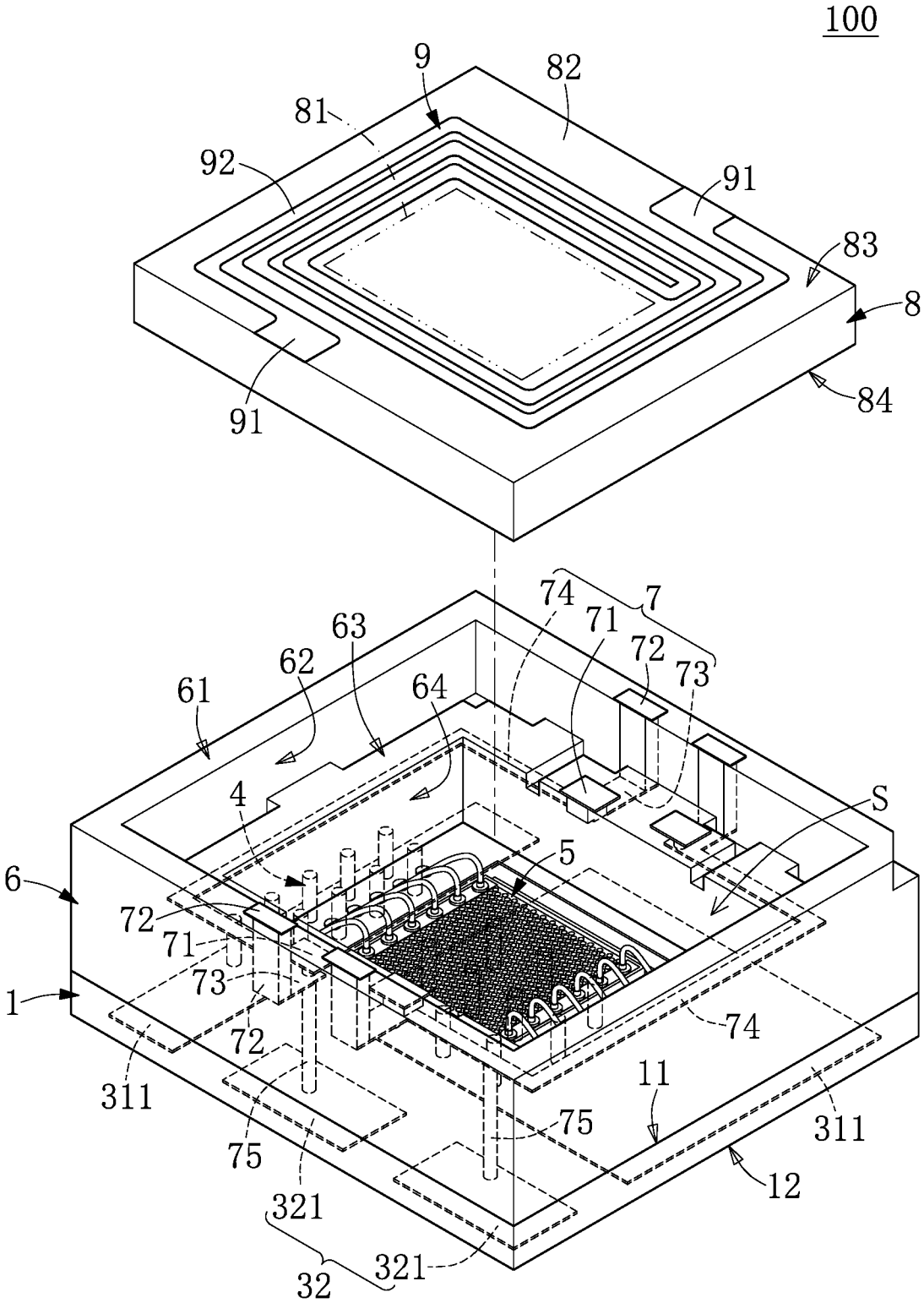
FIG. 12 is an exploded view of FIG. 11 with an adhesive layer and a conductive adhesive both omitted.

It should be noted that the shape and position of the two contacts 91 and the detecting trace 92 of each of the detecting circuits 9 can be adjusted or changed according to design requirement. For example, as shown in FIG. 11 and FIG. 12, the number of the detecting circuit 9 formed on the light permeable member 8 can be at least one. The detecting trace 92 of the at least one detecting circuit 9 is formed on the periphery portion 82 of the light permeable member 8 in two or three loops without being formed on the central portion 81. The two contacts 91 of the at least one detecting circuit 9 are respectively connected to two of the second pads 72 respectively disposed on the two upper tread 61 of the surrounding frame 6, or are respectively connected to two of the adjacent second pads 72.

Moreover, the two contacts 91 can be arranged adjacent to one of edges of the light permeable member 9 or can be respectively arranged adjacent to two of the edges of the light permeable member 8 opposite to each other, and the two contacts 91 are electrically coupled to two of the second pads 72.

Figure 13:
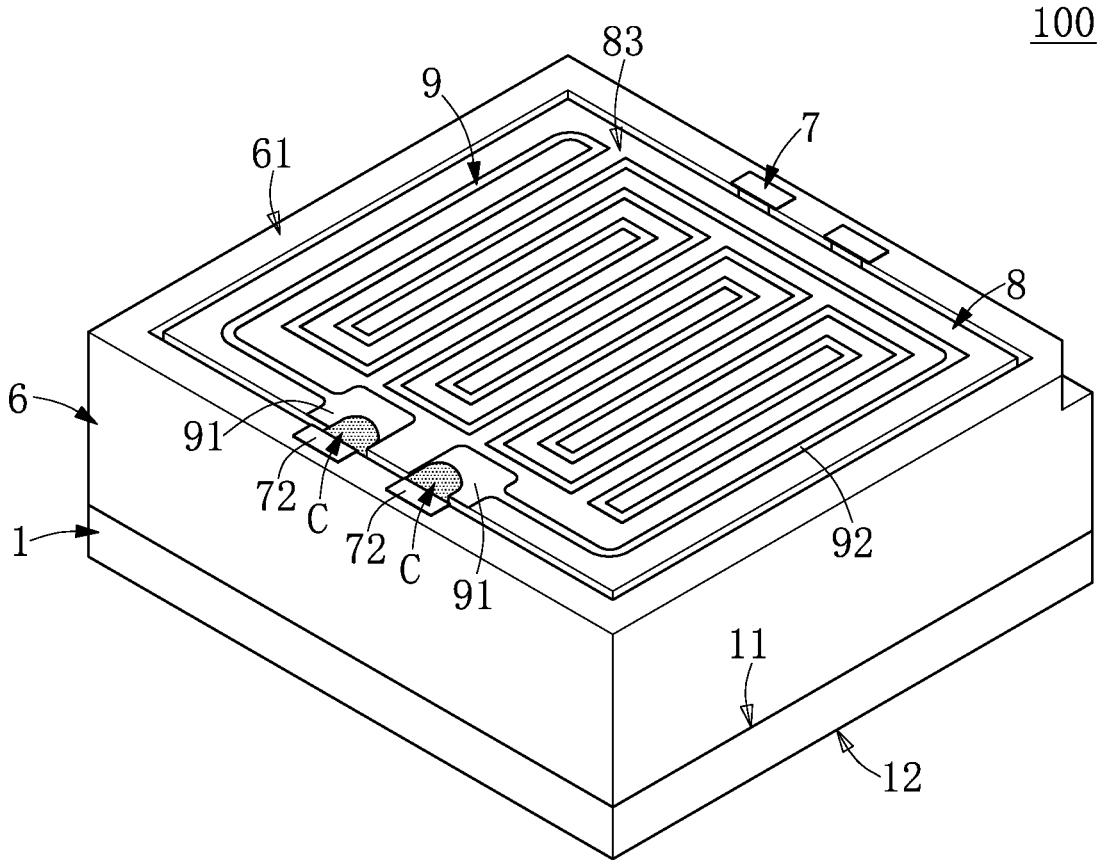
FIG. 13 is a perspective view of a light source device according to a fourth embodiment of the present disclosure.
Figure 14:
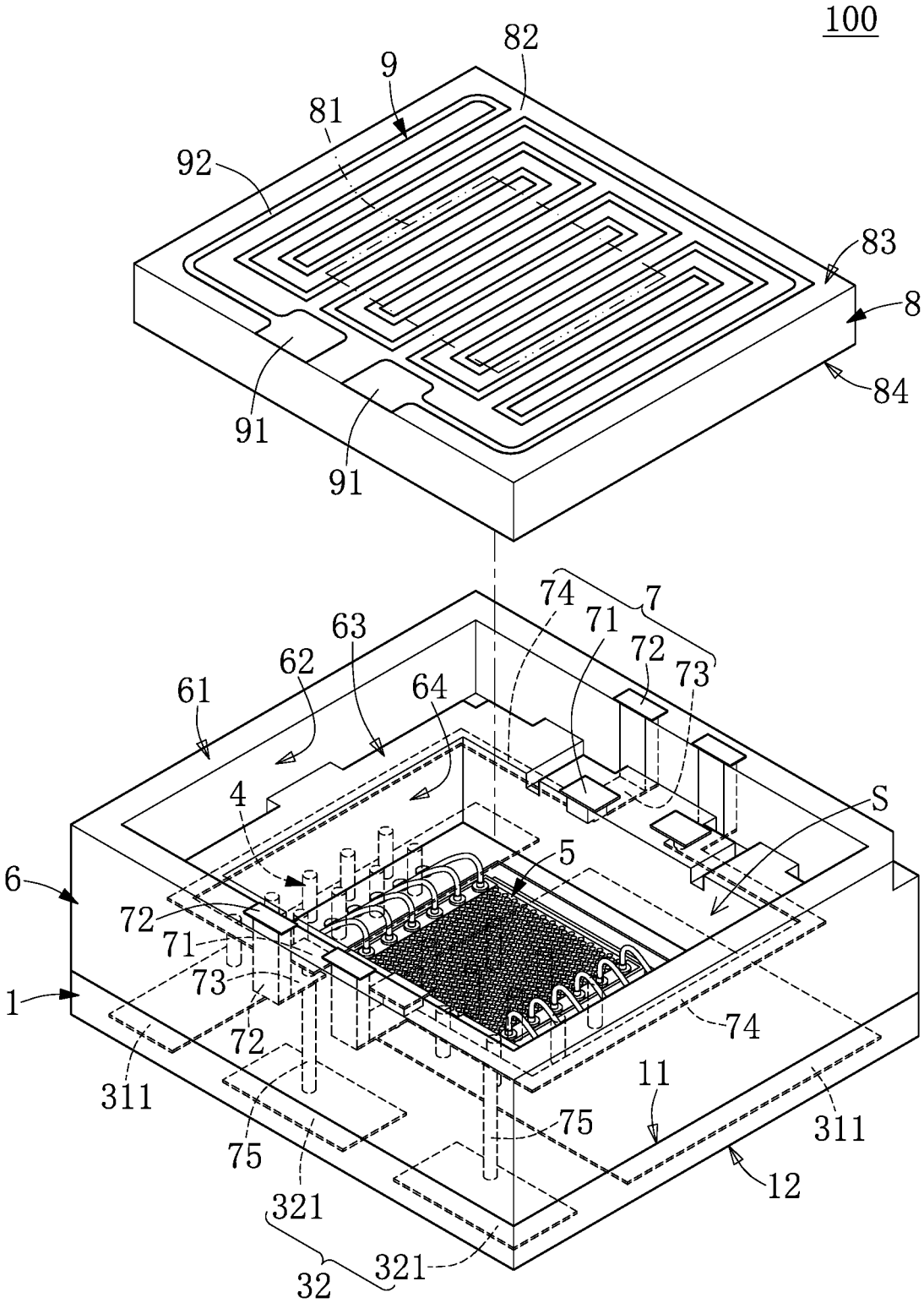
FIG. 14 is an exploded view of FIG. 13 with an adhesive layer and a conductive adhesive both omitted.

Moreover, the number of the detecting circuits 9 formed on the light permeable member 8 shown in FIG. 1 to FIG. 10 is two, but the present disclosure is not limited thereto. For example, as shown in FIG. 11, FIG. 12, FIG. 13, and FIG. 14, the number of the detecting circuit 9 formed on the light permeable member 8 can be at least one. As shown in FIG. 11 and FIG. 12, the detecting trace 92 of the at least one detecting circuit 9 can be formed on the periphery portion 82 of the light permeable member 8, and the two contacts 91 of the at least one detecting circuit 9 are electrically connected to two of the second pads 72 disposed on the two opposite sides of the upper tread 61. As shown in FIG. 13 and FIG. 14, the detecting trace 92 of the at least one detecting circuit 9 can be formed on the central portion 81 and the periphery portion 82 of the light permeable member 8, and the two contacts 91 of the at least one detecting circuit 9 are electrically connected to two of the second pads 72 disposed on one side of the upper tread 61. In other words, if the outer surface 83 of the light permeable member 8 is divided into a plurality of square areas in a matrix, the at least one detecting circuit 9 can be arranged to pass through all of the square areas, but the present disclosure is not limited thereto.

In addition, in the light source device 100 having the detecting circuit 9 formed on the outer surface 83 of the light permeable member 8, in order to increase the stability of the electrical connection between the contacts 91 and the second pads 72, the light source device 100 can further include at least one conductive sheet M (shown in FIG. 15) adhered to the conductive adhesive C. The number of the at least one conductive sheet M of the light source device 100 in the present embodiment is equal to the number of the second pads 72 of the conductive unit 7, but the present disclosure is not limited thereto.

Figure 15:
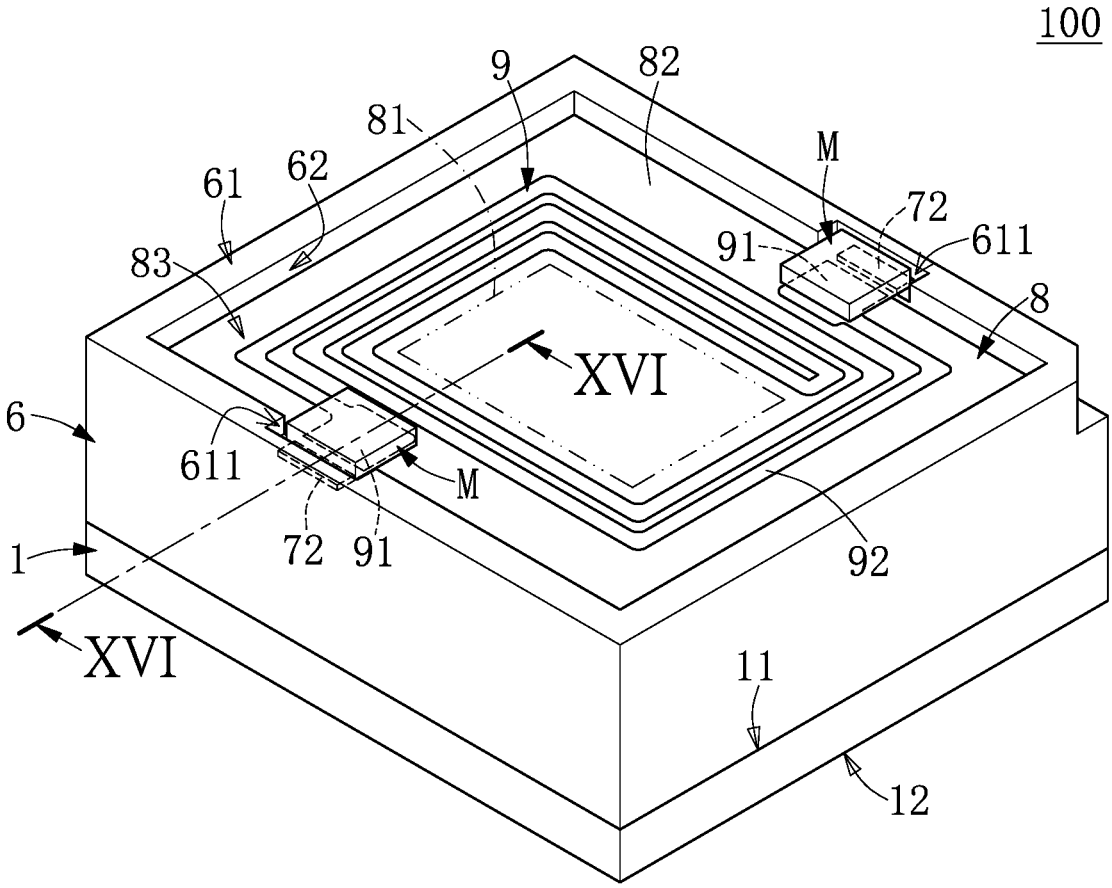
FIG. 15 is a perspective view of a light source device according to a fifth embodiment of the present disclosure.
Figure 16:
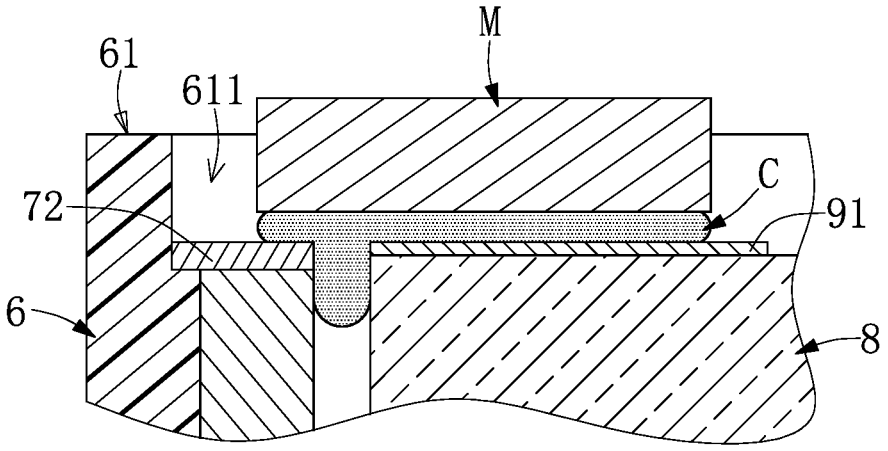
FIG. 16 is a cross-sectional view taken along the cross-sectional line XVI-XVI of FIG. 15.

Specifically, as shown in FIG. 15 and FIG. 16, the surrounding frame 6 includes two notches 611 recessed in a boundary of the upper tread 61 and the upper riser 62. The second pads 72 of the conductive unit 7 are respectively arranged in the two notches 611, and are substantially aligned with the two contacts 91 of the detecting circuit 9 in height. The electrical connection between any one of the contacts 91 of the detecting circuit 9 and the corresponding second pad 72 can be achieved by the follow manner. The conductive adhesive C is filled into a gap between the light permeable member 8 and the upper riser 62 and extends to each of the contacts 91 and the corresponding second pad 72 so as to electrically connect the contact 91, the corresponding second pad 72, and the corresponding conductive sheet M. Accordingly, the electrical connection between the contact 91 and the corresponding second pad 72 can be achieved by the conductive adhesive C and/or the conductive sheet M, thereby effectively increasing the stability of the electrical connection between the contact 91 and the corresponding second pad 72. Moreover, each of the conductive sheets M is straddled on the corresponding contact 91 and the corresponding second pad 71, and is partially arranged in the corresponding notch 611.

Figure 17:
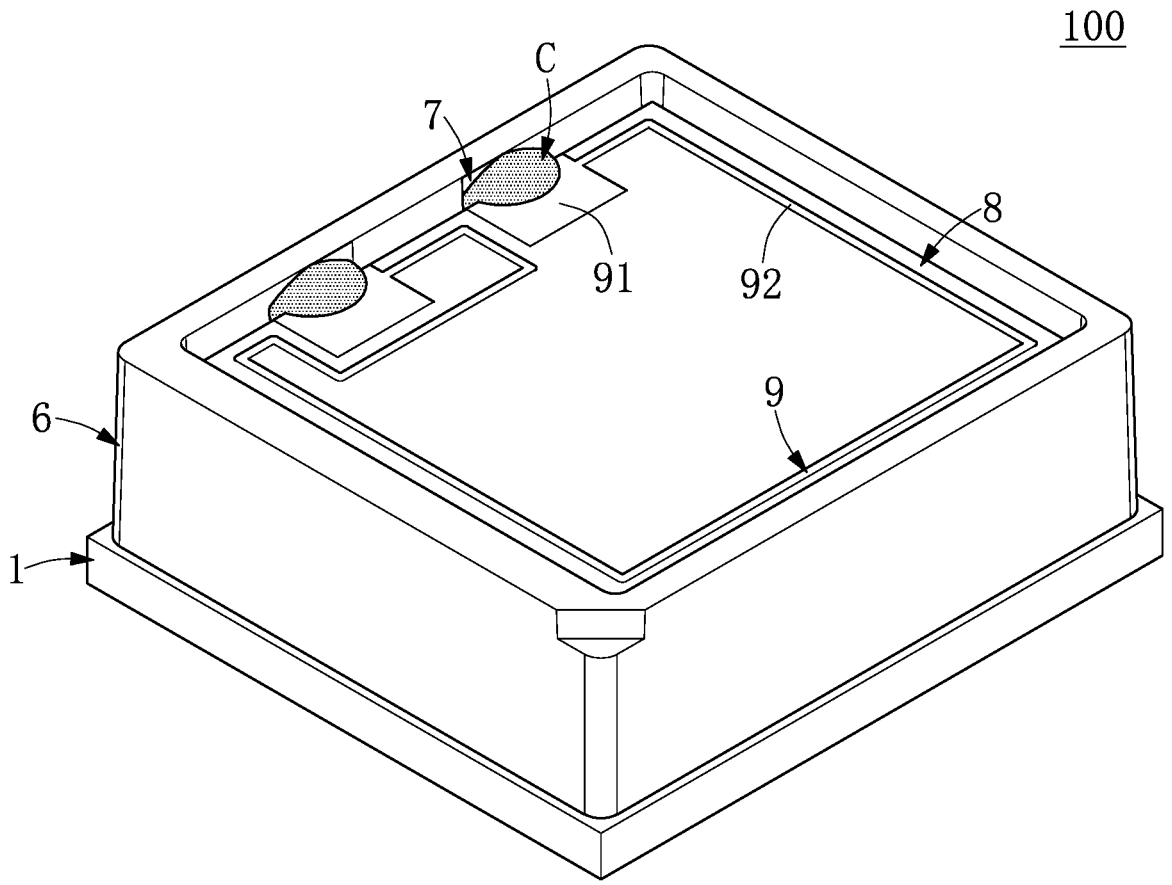
FIG. 17 is a perspective view of a light source device according to a sixth embodiment of the present disclosure.
Figure 18:
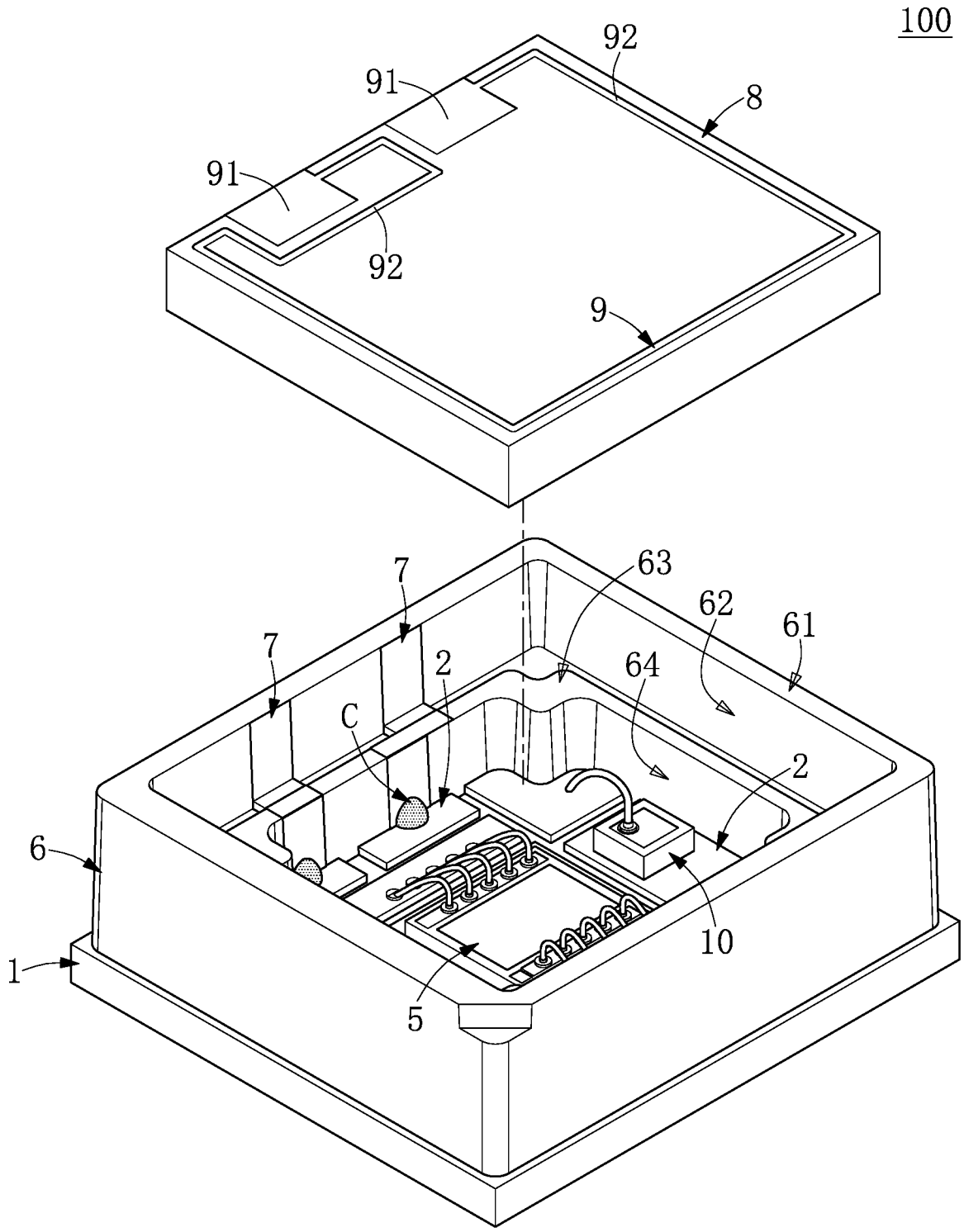
FIG. 18 is an exploded view of FIG. 17 with a conductive adhesive omitted.

As shown in FIG. 17 and FIG. 18, the light source device 100 can further include a photodiode sensor 10. The light emitting unit 5 and the photodiode sensor 10 are mounted on the upper electrode layer 2 and are electrically coupled to the first lower electrode sub-layer 31 through the upper electrode layer 2, and the light emitting unit 5 and the photodiode sensor 10 are electrically connected in series. Moreover, the conductive unit 7 is formed on an internal surface of the surrounding frame 6 by using a laser direct structuring (LDS) manner, and the conductive unit 7 is electrically connected to the contacts 91 of the detecting circuits 9 and the upper electrode layer 2 through the conductive adhesive C (e.g., silver glue).

Specifically, the conductive unit 7 in the present embodiment can include a pair of conductive traces, and each of the conductive traces is formed on the upper riser 62, the lower tread 63, and the lower riser 64. An upper portion of each of the conductive traces of the conductive unit 7 formed on the upper riser 62 is electrically connected to the corresponding contact 91 through the conductive adhesive C and can be defined as a first pad 71 or a second pad 72. A lower portion of each of the conductive traces of the conductive unit 7 formed on the lower riser 64 is electrically connected to the upper electrode layer 2 through conductive adhesive C.

In other embodiments of the present disclosure, the light source device 100 can be provided with a plurality of light emitting unit 5 for other applications, such as high power product.

Figure 19:
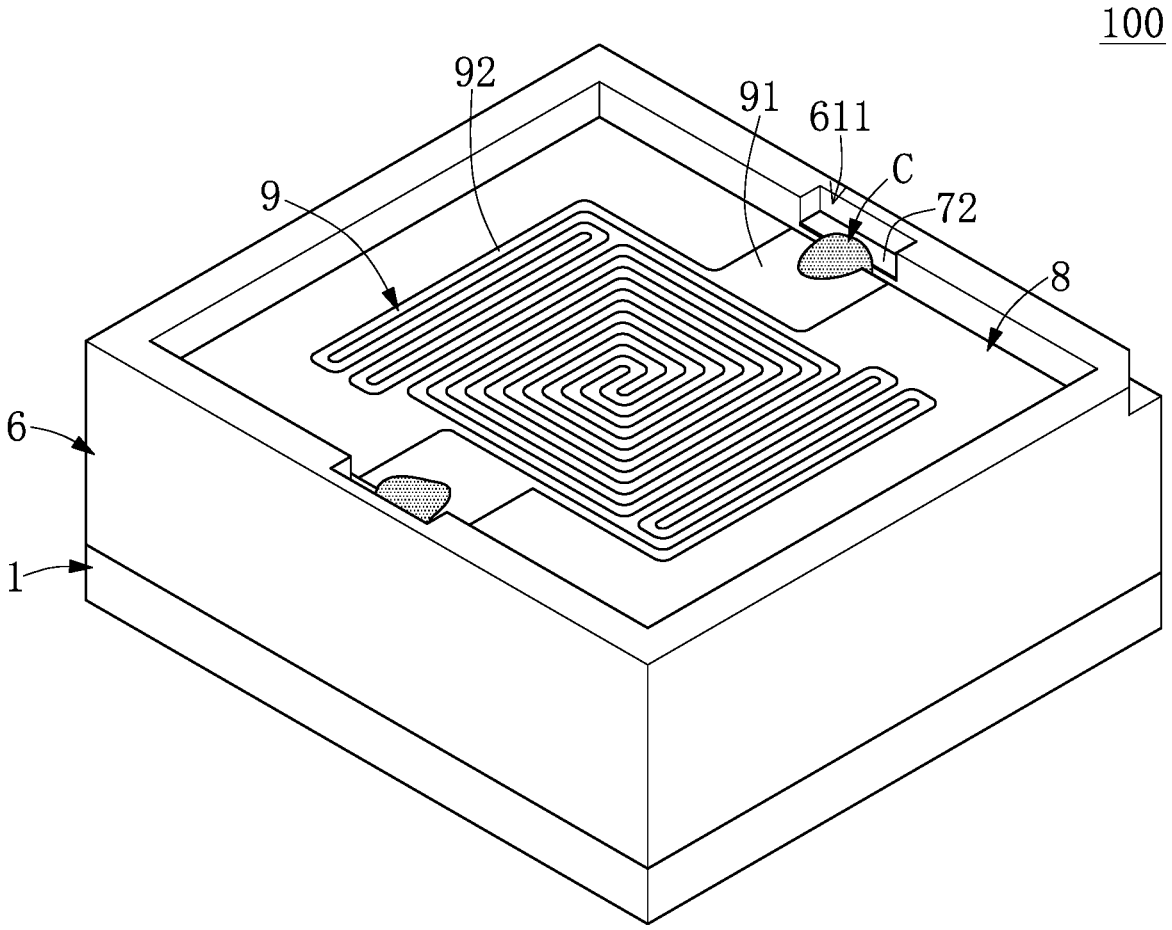
FIG. 19 is a perspective view of a light source device according to a seventh embodiment of the present disclosure.
Figure 20:
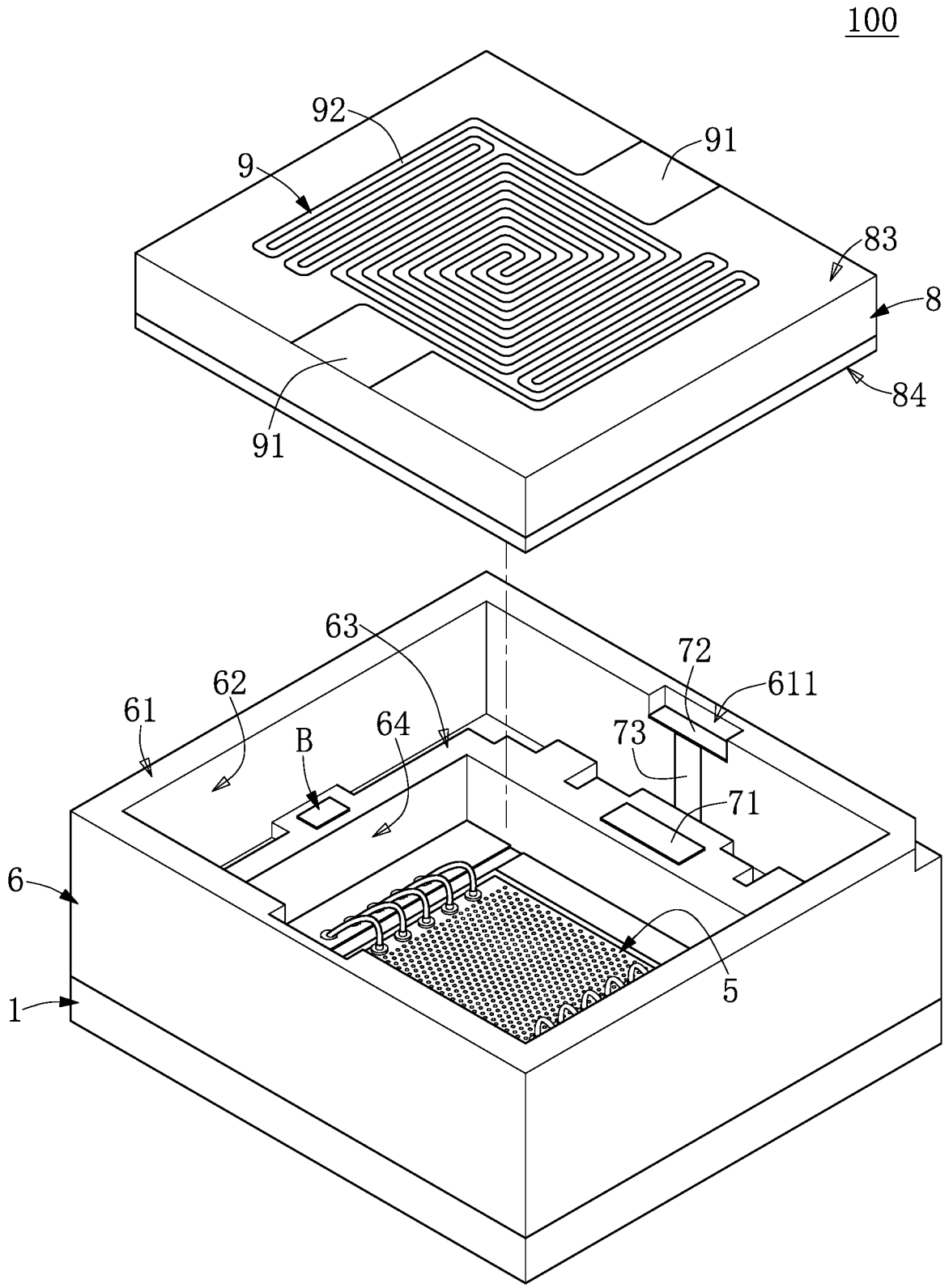
FIG. 20 is an exploded view of FIG. 19 with a conductive adhesive omitted.
Figure 21:
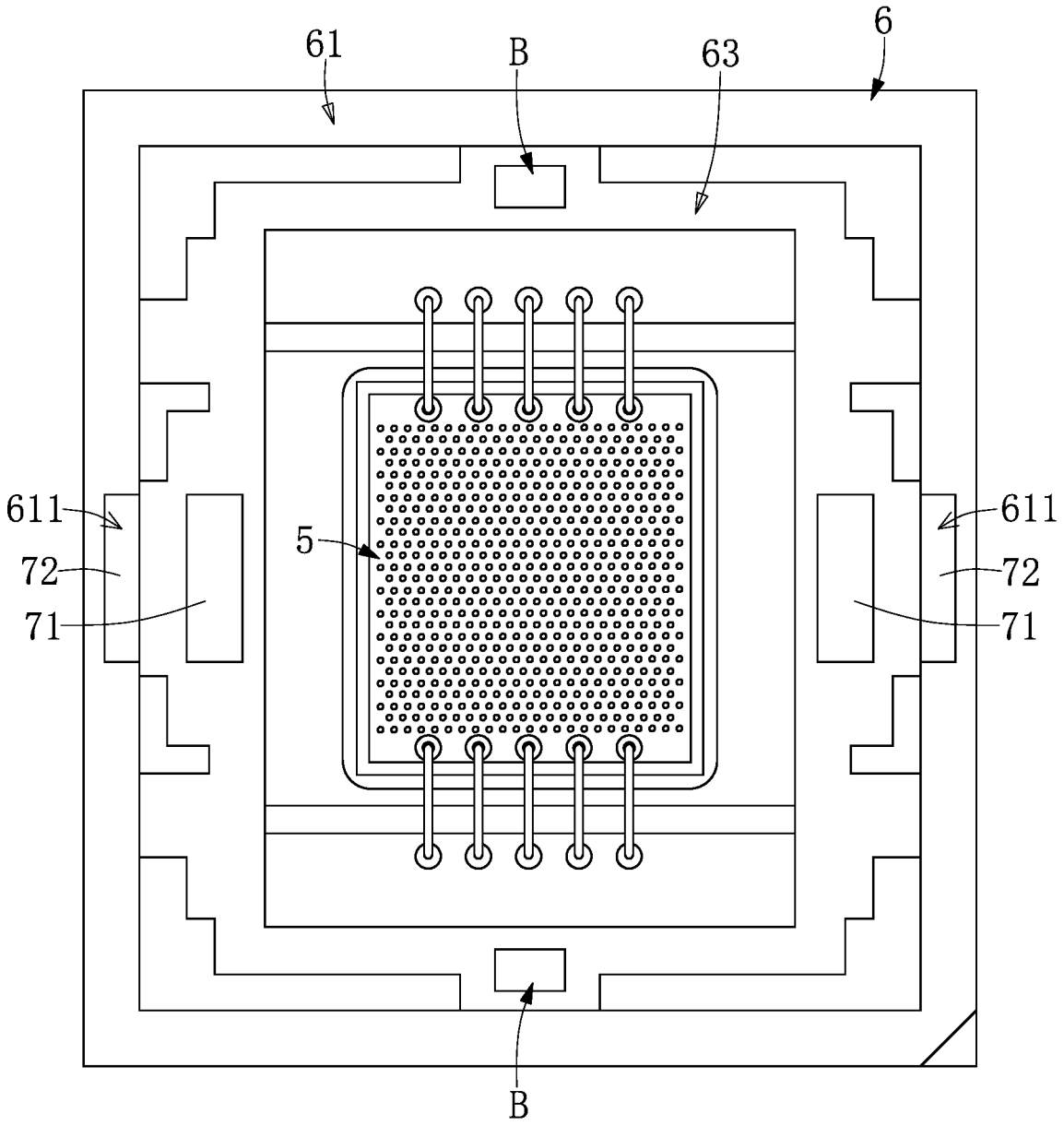
FIG. 21 is a top view of FIG. 20 with the conductive adhesive and a light permeable member both omitted.

As shown in FIG. 19 to FIG. 21, the surrounding frame 6 includes two notches 611 recessed in a boundary of the upper tread 61 and the upper riser 62, and the two notches 611 faces each other. The light source device 100 can be formed with two first pads 71 and two second pads 72. The two first pads 71 are disposed on the lower tread 63 and are respectively arranged adjacent to the two notches 611, and the two second pads 72 are respectively arranged in the two notches 611. The two second pads 72 are electrically connected to the two first pads 71 through the respectively one of the connecting traces 73.

Moreover, the light source device 100 further includes two balance pads B disposed on the lower tread 63. The two balance pads B and the two first pads 71 are in contact with the inner surface 84 of the light permeable member 8, and are respectively adjacent to four edges of the inner surface 84. Specifically, a height of each of the two balance pads B with respect to the lower tread 63 is equal to a height of each of the two first pads 71 with respect to the lower tread 63. Therefore, the light permeable member 8 disposed on the lower tread 63 is more firmly.

In conclusion, since the surrounding frame of the light source device in the present disclosure is formed with the conductive unit, the at least one detecting circuit on the light permeable member can be electrically coupled to the second lower electrode sub-layer through the conductive unit. Accordingly, the impedance of the at least one detecting circuit can be tested and obtained by the second lower electrode sub-layer, thereby monitoring whether or not the light permeable member is damaged.

Moreover, two different assemblies respectively provided by forming the at least one detecting circuit onto the outer surface and the inner surface of the light permeable member can be applied to the light source device of the present disclosure through the structural design of the conductive unit (e.g., the first pads and the second pads on the surrounding frame are located at different height).

In addition, each of the two functional regions is spaced apart from any of the U-shaped regions through one of the separating slots, so that the two functional regions can avoid electrical failure due to contact with the adhesive layer.

When the detecting trace 92 of the detecting circuit 9 is formed on the light permeable member 8 in at least two loops manner, the electrical signal, such as voltage, resistance, impedance or the conductance, can be measured more accurately. Therefore, the crack level of the light permeable member 8 can be monitored for eye safety function.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A light source device, comprising:

a substrate having a first surface and a second surface that is opposite to the first surface;

an upper electrode layer and a lower electrode layer disposed on the first surface and the second surface of the substrate, respectively, wherein the lower electrode layer includes a first lower electrode sub-layer and a second lower electrode sub-layer that is coplanar with the first lower electrode sub-layer;

a light emitting unit mounted on the upper electrode layer, wherein the light emitting unit is electrically coupled to the first lower electrode sub-layer through the upper electrode layer;

a surrounding frame disposed on the first surface and surrounding an external side of the light emitting unit;

a conductive unit disposed on the surrounding frame and electrically coupled to the second lower electrode sub-layer, wherein the conductive unit includes a plurality of first pads or a plurality of second pads, and a first height of the first pads on the surrounding frame with respect to the substrate is different from a second height of the second pads of the surrounding frame with respect to the substrate;

a light permeable member disposed on the surrounding frame and covering the light emitting unit; and at least one detecting circuit formed on the light permeable member and including at least two contacts, wherein the at least two contacts of the at least one detecting circuit are connected to the first pads or the second pads, and the at least one detecting circuit is electrically coupled to the second lower electrode sub-layer through the conductive unit.

2. The light source device according to claim 1, wherein the light permeable member has a central portion and a periphery portion that is arranged around the central portion, the light emitting unit is located directly under the central portion, and wherein the at least two contacts of the at least one detecting circuit are formed on the periphery portion and correspond in position to the surrounding frame so as to be connected to the first pads or the second pads.

3. The light source device according to claim 2, wherein the at least one detecting circuit is light permeable and includes a detecting trace connected to the at least two contacts, and the detecting trace is formed on at least one of the central portion and the periphery portion.

4. The light source device according to claim 1, wherein the surrounding frame is step-like and includes:

an upper tread arranged away from the substrate;

an upper riser connected to an inner edge of the upper tread;

a lower tread arranged at an inner side of the tread, wherein a distance between the lower tread and the first surface is less than a distance between the upper tread and the first surface; and a lower riser connected to an inner edge of the lower tread and arranged away from the upper tread, wherein the lower riser surrounds the external side of the light emitting unit, wherein the first pads are disposed on the lower tread, and the second pads are disposed on at least one of the upper tread and the upper riser.

5. The light source device according to claim 4, wherein the light permeable member has an outer surface and an inner surface that is opposite to the outer surface, and the inner surface faces the light emitting unit, wherein the at least one detecting circuit is formed on the inner surface, and the at least two contacts of the at least one detecting circuit are connected to the first pads.

6. The light source device according to claim 4, wherein the light permeable member has an outer surface and an inner surface that is opposite to the outer surface, and the inner surface faces the light emitting unit, and wherein the at least one detecting circuit is formed on the outer surface, and the at least two contacts of the at least one detecting circuit are connected to the second pads.

7. The light source device according to claim 4, wherein the light permeable member has an outer surface and an inner surface that is opposite to the outer surface, the inner surface faces the light emitting unit, and the second pads are disposed on the upper riser, and wherein the at least one detecting circuit is formed on the outer surface, positions of the at least one detecting circuit and the outer surface are lower than the upper tread, and the at least two contacts of the at least one detecting circuit are electrically connected to the second pads.

8. The light source device according to claim 4, further comprising a plurality of balance pads disposed on the lower tread, wherein the balance pads and the first pads are in contact with an inner surface of the light permeable member that faces the light emitting unit, and are respectively adjacent to edges of the inner surface, and wherein a height of each of the balance pads with respect to the lower tread is equal to a height of each of the first pads with respect to the lower tread.

9. The light source device according to claim 4, wherein the lower tread includes:

two U-shaped regions, wherein inner edges of the two U-shaped regions face each other, and two external corners of each of the two U-shaped regions each have a receiving groove; and two functional regions arranged between the two U-shaped regions, wherein the first pads are respectively disposed on the two functional regions.

10. The light source device according to claim 9, wherein the lower tread has a plurality of separating slots, and the two functional regions are spaced apart from the two U-shaped regions through the separating slots.

11. The light source device according to claim 9, wherein the first pads are electrically coupled to the second pads, the conductive unit includes at least one transmission trace embedded in the surrounding frame, and two ends of the at least one transmission trace are respectively connected to two of the first pads respectively disposed on the two functional regions.

12. The light source device according to claim 9, wherein the at least two contacts of the at least one detecting circuit are respectively connected to two of the first pads respectively disposed on the two functional regions, or are respectively connected to two of the adjacent second pads.

13. A light source device, comprising:

a substrate having a first surface and a second surface opposite to the first surface;

an upper electrode layer and a lower electrode layer both respectively disposed on the first surface and the second surface of the substrate, wherein the lower electrode layer includes a first lower electrode sub-layer and a second lower electrode sub-layer that is coplanar with the first lower electrode sub-layer;

a light emitting unit mounted on the upper electrode layer, wherein the light emitting unit is electrically coupled to the first lower electrode sub-layer through the upper electrode layer;

a surrounding frame disposed on the first surface and surrounding an external side of the light emitting unit;

a conductive unit disposed on the surrounding frame and electrically coupled to the second lower electrode sub-layer;

a light permeable member disposed on the surrounding frame and covering the light emitting unit, wherein the light permeable member has an outer surface and an inner surface opposite to the outer surface; and at least one detecting circuit formed on one of the inner surface and the outer surface and including two contacts, wherein the two contacts of the at least one detecting circuit are connected to the conductive unit, and the at least one detecting circuit is electrically coupled to the second lower electrode sub-layer through the conductive unit.

14. The light source device according to claim 13, wherein the conductive unit includes two U-shaped transmission traces embedded in the surrounding frame and spaced apart from each other, the two transmission traces are electrically coupled to the second lower electrode sub-layer, and the two transmission traces are electrically coupled to the at least one detecting circuit, respectively.

15. The light source device according to claim 13, wherein the at least one detecting circuit is formed on the inner surface of the light permeable member, and the two contacts are arranged adjacent to one of edges of the light permeable member or are respectively arranged adjacent to two of the edges of the light permeable member opposite to each other, and wherein the conductive unit includes a plurality of first pads disposed on the surrounding frame, and the two contacts are respectively disposed on two of the first pads.

16. The light source device according to claim 13, wherein the at least one detecting circuit is formed on the outer surface of the light permeable member, and the two contacts are arranged adjacent to one of edges of the light permeable member or are respectively arranged adjacent to two of the edges of the light permeable member opposite to each other, and wherein the conductive unit includes a plurality of first pads disposed on the surrounding frame and a plurality of second pads disposed on the surrounding frame, a first height of the first pads on the surrounding frame with respect to the substrate is different from a second height of the second pads of the surrounding frame with respect to the substrate, and the two contacts are electrically coupled to two of the second pads.

17. The light source device according to claim 16, wherein each of the two contacts is electrically coupled to the corresponding second pad through a conductive adhesive or a conductive sheet.

18. The light source device according to claim 13, wherein the number of the at least one detecting unit is two, and the two detecting units are formed on the inner surface of the light permeable member and each have two contacts, and wherein the conductive unit includes four first pads disposed on the surrounding frame, and the four contacts of the two detecting units correspond in position to the four first pads, respectively.

19. The light source device according to claim 13, wherein the number of the at least one detecting unit is two, and the two detecting units are formed on the outer surface of the light permeable member and each have two contacts, and wherein the conductive unit includes a plurality of first pads disposed on the surrounding frame and a plurality of second pads disposed on the surrounding frame, a first height of the first pads on the surrounding frame with respect to the substrate is different from a second height of the second pads on the surrounding frame with respect to the substrate, and the four contacts of the two detecting units are electrically coupled and correspond in position to the four second pads, respectively.

20. The light source device according to claim 13, further comprising a photodiode sensor mounted on the upper electrode layer and electrically coupled to the first lower electrode sub-layer through the upper electrode layer.

21. The light source device according to claim 13, further comprising a plurality of conductive posts embedded in the substrate, wherein a first group of the conductive posts is arranged under the light emitting unit, and a second group of the conductive posts is arranged under a part of the upper electrode layer that is configured to provide wire-bonding of the light emitting unit.

22. The light source device according to claim 13, wherein the conductive unit is formed on an internal surface of the surrounding frame by using a laser direct structuring (LDS) manner.

* * * * *